US011483653B2

(12) United States Patent
Hayashi et al.

(10) Patent No.: US 11,483,653 B2
(45) Date of Patent: Oct. 25, 2022

(54) NOISE REDUCTION DEVICE, VEHICLE, AND NOISE REDUCTION METHOD

(71) Applicant: Panasonic Intellectual Property Management Co., Ltd., Osaka (JP)

(72) Inventors: Yoshiyuki Hayashi, Osaka (JP); Atsuhiro Hara, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/091,838

(22) Filed: Nov. 6, 2020

(65) Prior Publication Data

US 2021/0211803 A1 Jul. 8, 2021

(30) Foreign Application Priority Data

Nov. 15, 2019 (JP) ..... JP2019-207026

(51) Int. Cl.
*H04R 3/02* (2006.01)
*H04R 1/02* (2006.01)

(52) U.S. Cl.
CPC ..... *H04R 3/02* (2013.01); *H04R 1/025* (2013.01); *H04R 1/028* (2013.01); *H04R 2499/11* (2013.01); *H04R 2499/13* (2013.01)

(58) Field of Classification Search
CPC ..... H04R 3/02; H04R 1/025; H04R 1/028; H04R 2499/11; H04R 2499/13
USPC ..... 381/71.4, 71.11, 71.12, 71.1, 86, 94.1, 381/84.2, 122, 150
See application file for complete search history.

(56) References Cited

U.S. PATENT DOCUMENTS 5,267,320 A * 11/1993 Fukumizu ..... G10K 11/17854 381/71.12
2004/0042624 A1* 3/2004 Henderson ..... H03G 3/32 381/86
2009/0052690 A1* 2/2009 Bachmann ..... H03H 21/0012 381/94.1
2009/0316923 A1* 12/2009 Tashev ..... H04M 9/082 381/71.1
2016/0101710 A1* 4/2016 Bonk ..... B60N 2/0248 297/217.2
2019/0080681 A1 3/2019 Hayashi

FOREIGN PATENT DOCUMENTS

JP 2008-149922 * 7/2008
JP 5829052 12/2015
JP 2019-053095 4/2019

* cited by examiner

*Primary Examiner* — Vivian C Chin
*Assistant Examiner* — Con P Tran
(74) *Attorney, Agent, or Firm* — Greenblum & Bernstein, P.L.C.

(57) ABSTRACT

A noise reduction device reduces noise occurring in a space inside a mobile apparatus. The noise reduction device includes: a status signal receiver to which a status signal indicating a status of a movable component provided for the mobile apparatus is inputted; and a controller that, when the status signal inputted indicates that the movable component is not in a predetermined base status, performs control over the output of the cancelling sound differently in each case, depending on whether or not the status signal includes information indicating a shift amount of the movable component.

18 Claims, 18 Drawing Sheets

FIG. 12

| | Speaker SP0 | Speaker SP1 | Speaker SP2 | Speaker SP3 | Speaker SP4 |
|---|---|---|---|---|---|
| Doors DR0 and DR1 opened | Deactivated | Deactivated | Activated | Activated | Activated |
| Doors DR2 and DR3 opened | Activated | Activated | Deactivated | Deactivated | Activated |
| Door DR4 opened | Activated | Activated | Activated | Activated | Deactivated |

FIG. 13

| | Microphone M0 | Microphone M1 | Microphone M2 | Microphone M3 |
|---|---|---|---|---|
| Doors DR0 and DR1 opened | Deactivated | Deactivated | Activated | Activated |
| Doors DR2 and DR3 opened | Activated | Activated | Deactivated | Activated |
| Door DR4 opened | Activated | Activated | Activated | Deactivated |

FIG. 14

| | Speaker SP0 | | Speaker SP1 | | Speaker SP2 | | Speaker SP3 | | Speaker SP4 | |
|---|---|---|---|---|---|---|---|---|---|---|
| Frequency range for speaker to be deactivated | Lower limit | Upper limit | Lower limit | Upper limit | Lower limit | Upper limit | Lower limit | Upper limit | Lower limit | Upper limit |
| Doors DR0 and DR1 opened | 1 | 300 | 1 | 300 | No limit (Activated normally) | | No limit (Activated normally) | | No limit (Activated normally) | |
| Doors DR2 and DR3 opened | No limit (Activated normally) | | No limit (Activated normally) | | 1 | 300 | 1 | 300 | 65 | 100 |
| Doors DR4 opened | 45 | 100 | 45 | 95 | No limit (Activated normally) | | No limit (Activated normally) | | 1 | 300 |

FIG. 15

| | Microphone M0 | | Microphone M1 | | Microphone M2 | | Microphone M3 | |
|---|---|---|---|---|---|---|---|---|
| Frequency range for speaker to be deactivated | Lower limit | Upper limit | Lower limit | Upper limit | Lower limit | Upper limit | Lower limit | Upper limit |
| Doors DR0 and DR1 opened | 1 | 300 | 1 | 300 | 1 | 70 | 1 | 60 |
| Doors DR2 and DR3 opened | No limit (Activated normally) | | No limit (Activated normally) | | 1 | 300 | No limit (Activated normally) | |
| Doors DR4 opened | 45 | 70 | 45 | 70 | No limit (Activated normally) | | 1 | 300 |

FIG. 17

| | ADF for speaker SP0 (ADF0) | ADF for speaker SP1 (ADF1) | ADF for speaker SP2 (ADF2) | ADF for speaker SP3 (ADF3) | ADF for speaker SP4 (ADF4) |
|---|---|---|---|---|---|
| Doors DR0 and DR1 opened | Deactivated | Deactivated | Reduce step-size parameter by half | Reduce step-size parameter by half | Activated normally |
| Doors DR2 and DR3 opened | Double $\alpha$ coefficient | Double $\alpha$ coefficient | Deactivated | Deactivated | Reduce step-size parameter by half |
| Door DR4 opened | Double $\alpha$ coefficient | Double $\alpha$ coefficient | Reduce step-size parameter by half and double $\alpha$ coefficient | Reduce step-size parameter by half and double $\alpha$ coefficient | Deactivated |

NOISE REDUCTION DEVICE, VEHICLE, AND NOISE REDUCTION METHOD

CROSS REFERENCE TO RELATED APPLICATION

The present application claims the benefit of Japanese Patent Application No. 2019-207026 filed Nov. 15, 2019. The entire disclosure of the above-identified application, including the specification, drawings and claims is incorporated herein by reference in its entirety.

The present disclosure relates to a noise reduction device and so forth that actively reduce noise.

BACKGROUND

A conventional noise reduction device is known to actively reduce noise occurring at a listening position by outputting a noise-canceling sound from a speaker. Examples of such noise reduction device include an active noise-canceling device disclosed in Patent Literature (PTL) 1.

CITATION LIST

Patent Literature

PTL 1: Japanese Patent No. 5829052

SUMMARY

Technical Problem

However, the active noise-canceling device according to PTL 1 can be improved upon.

In view of this, the present disclosure provides a noise reduction device, a mobile apparatus, and a noise reduction method capable of improving upon the above related art.

Solution to Problem

In accordance with an aspect of the present disclosure, a noise reduction device reduces noise occurring in a space inside a mobile apparatus, and includes: a reference signal receiver to which a reference signal correlating with the noise is inputted; an adaptive filter applier that generates a cancel signal used in an output of a cancelling sound for reducing the noise, by applying an adaptive filter, which has a coefficient sequentially updated, to a base signal having a frequency identified based on the reference signal inputted; a cancel signal output unit that outputs the cancel signal generated to a speaker placed in the space; a status signal receiver to which a status signal indicating a status of a movable component provided for the mobile apparatus is inputted; and a controller that, when the status signal inputted indicates that the movable component is not in a predetermined base status, performs control over the output of the cancelling sound differently in each case, depending on whether or not the status signal includes information indicating a shift amount of the movable component.

In accordance with another aspect of the present disclosure, a mobile apparatus includes: the noise reduction device described above; and the speaker described above.

In accordance with still another aspect of the present disclosure, a noise reduction method for reducing noise occurring in a space inside a mobile apparatus includes: generating a cancel signal used in an output of a cancelling sound for reducing the noise, by applying an adaptive filter, which has a coefficient sequentially updated, to a base signal having a frequency identified based on a reference signal correlating with the noise; outputting the cancel signal generated to a speaker placed in the space; and performing, when a status signal indicating a status of a movable component provided for the mobile apparatus indicates that the movable component is not in a predetermined base status, control over the output of the cancelling sound differently in each case, depending on whether or not the status signal includes information indicating a shift amount of the movable component.

Advantageous Effects

A noise reduction device and so forth according to one aspect of the present disclosure is capable of improving upon the above related art.

BRIEF DESCRIPTION OF DRAWINGS

These and other objects, advantages and features of the present disclosure will become apparent from the following description thereof taken in conjunction with the accompanying drawings that illustrate a specific embodiment of the present disclosure.

FIG. 12 illustrates a first example of speaker control table information.

FIG. 13 illustrates a first example of microphone control table information.

FIG. 14 illustrates a second example of the speaker control table information.

FIG. 15 illustrates a second example of the microphone control table information.

FIG. 17 illustrates an example of ADF control table information.

DESCRIPTION OF EMBODIMENTS

Hereinafter, certain exemplary embodiments will be described in detail with reference to the accompanying Drawings. The following embodiments are general or specific examples of the present disclosure. The numerical values, shapes, materials, elements, arrangement and connection configuration of the elements, steps, the order of the steps, etc., described in the following embodiments are merely examples, and are not intended to limit the present disclosure. Among elements in the following embodiments, those not described in any one of the independent claims indicating the broadest concept of the present disclosure are described as optional elements.

It should be noted that the respective figures are schematic diagrams and are not necessarily precise illustrations. Additionally, components that are essentially the same share like reference signs in the figures. Accordingly, overlapping explanations thereof are omitted or simplified.

Embodiment 1

[Overview]

Figure 1:
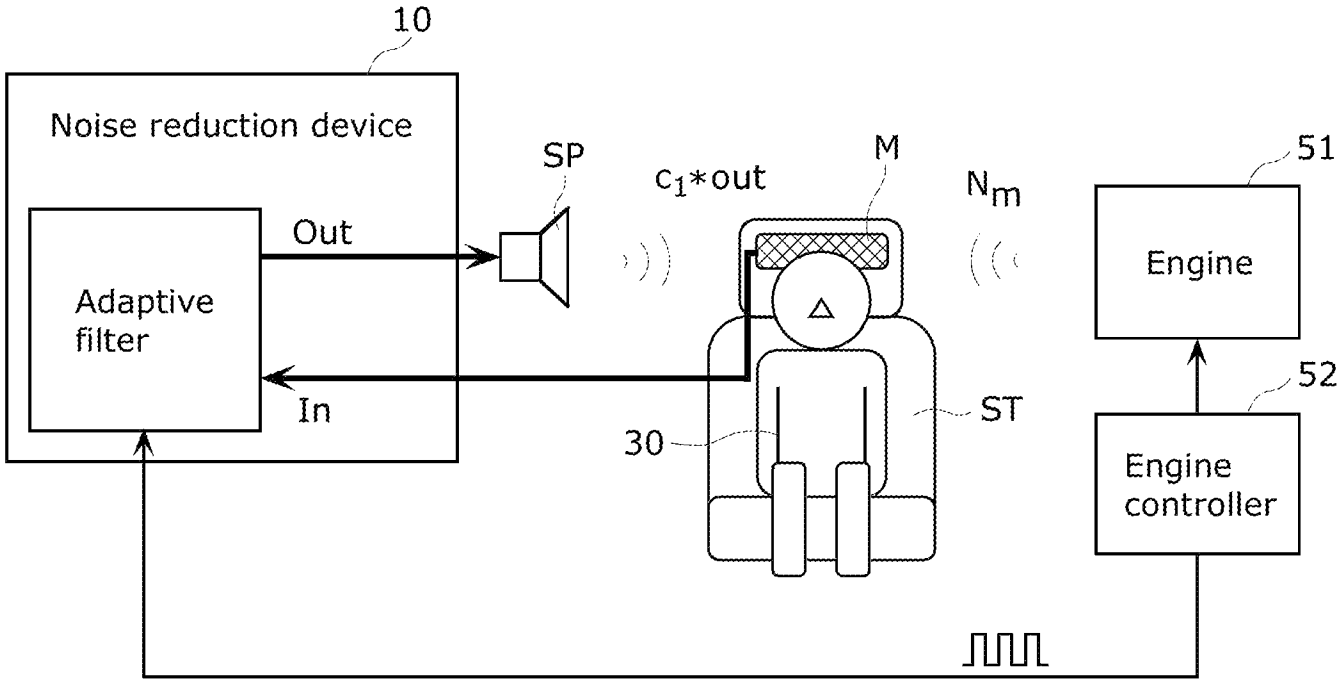
FIG. 1 illustrates an overview of a noise reduction device according to Embodiment 1.

First, an overview of a noise reduction device according to Embodiment 1 is described. FIG. 1 illustrates the overview of the noise reduction device according to Embodiment 1.

Noise reduction device 10 illustrated in FIG. 1 is installed in an interior of an automobile and reduces noise occurring while the automobile is moving, for example. Noise caused by engine 51 is a sound instantaneously close to a single-frequency sine wave. Thus, noise reduction device 10 obtains a pulse signal indicating a frequency of engine 51, from engine controller 52 that controls engine 51. Then, noise reduction device 10 outputs a cancelling sound from speaker SP to cancel the noise. The cancelling sound is generated using an adaptive filter to reduce a residual sound obtained by microphone M located near listener 30.

As illustrated in FIG. 1, a transmission characteristic from a position of speaker SP (hereinafter, also referred to as the sound output position) to a position of microphone M (hereinafter, also referred to as the sound collection position) is indicated by "$c_1$". Moreover, an output signal for outputting the cancelling sound is indicated by "out". In this case, the cancelling sound reaching the position of microphone M (the sound collection position) is expressed as "$c_1$*out". Here, "*" represents a convolution operator, "$c_1$" represents an impulse response of the transmission characteristic, and "$C_1$" represents a simulated transmission characteristic in a frequency domain.

Noise $N_m$ at the position of microphone M is expressed by Equation 1 below, and $c_1$*out is expressed by Equations 2-1 and 2-2 below. In these equations, R represents an amplitude, ω represents an angular frequency, and θ represents a phase. Noise reduction device 10 is capable of outputting a cancelling sound for canceling noise by calculating first filter coefficient A and second filter coefficient B in Equations 2-1 and 2-2 according to a least mean square (LMS) algorithm, for example.

[Math. 1]

$$N_m = R\cdot\sin(\omega t+\theta) \quad \text{(Equation 1)}$$

$$c_1\text{*out} = R\cdot\sin[\omega t+(\theta-\pi)]$$

when $C_1-1$, $$c_1\text{*out} = R\cdot\sin[\omega t+(\theta-\pi)] = A\cdot\sin(\omega t)+B\cdot\sin(\omega t)$$

where, $$R=\sqrt{A^2+B^2},\ \theta-\pi=\tan^{-1}(B/A) \quad \text{(Equation 2-1)}$$

when $C_1\neq 1$, $$c_1\text{*out} = R\cdot\sin[\omega t+(\theta-\pi)] = A'\cdot\sin(\omega t)+B'\cdot\sin(\omega t)$$

where, $$R=\sqrt{A'^2+B'^2},\ \theta-\pi=\tan^{-1}(B'/A'),$$

$$A'+jB' = C_1(\omega)(A+jB) \quad \text{(Equation 2-2)}$$

Figure 2:
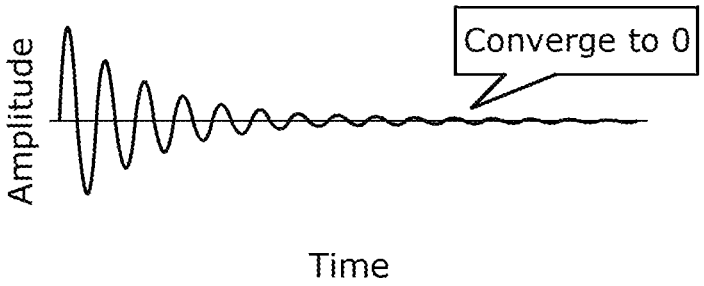
FIG. 2 schematically illustrates a temporal waveform of noise heard at a position of a microphone.

The cancelling sound opposite in phase to noise $N_m$ decreases the noise heard at the position of microphone M as illustrated in FIG. 2. FIG. 2 schematically illustrates a temporal waveform of the noise heard at the position of microphone M.

[Overall Configuration of Vehicle Provided with Noise Reduction Device]

Figure 3:
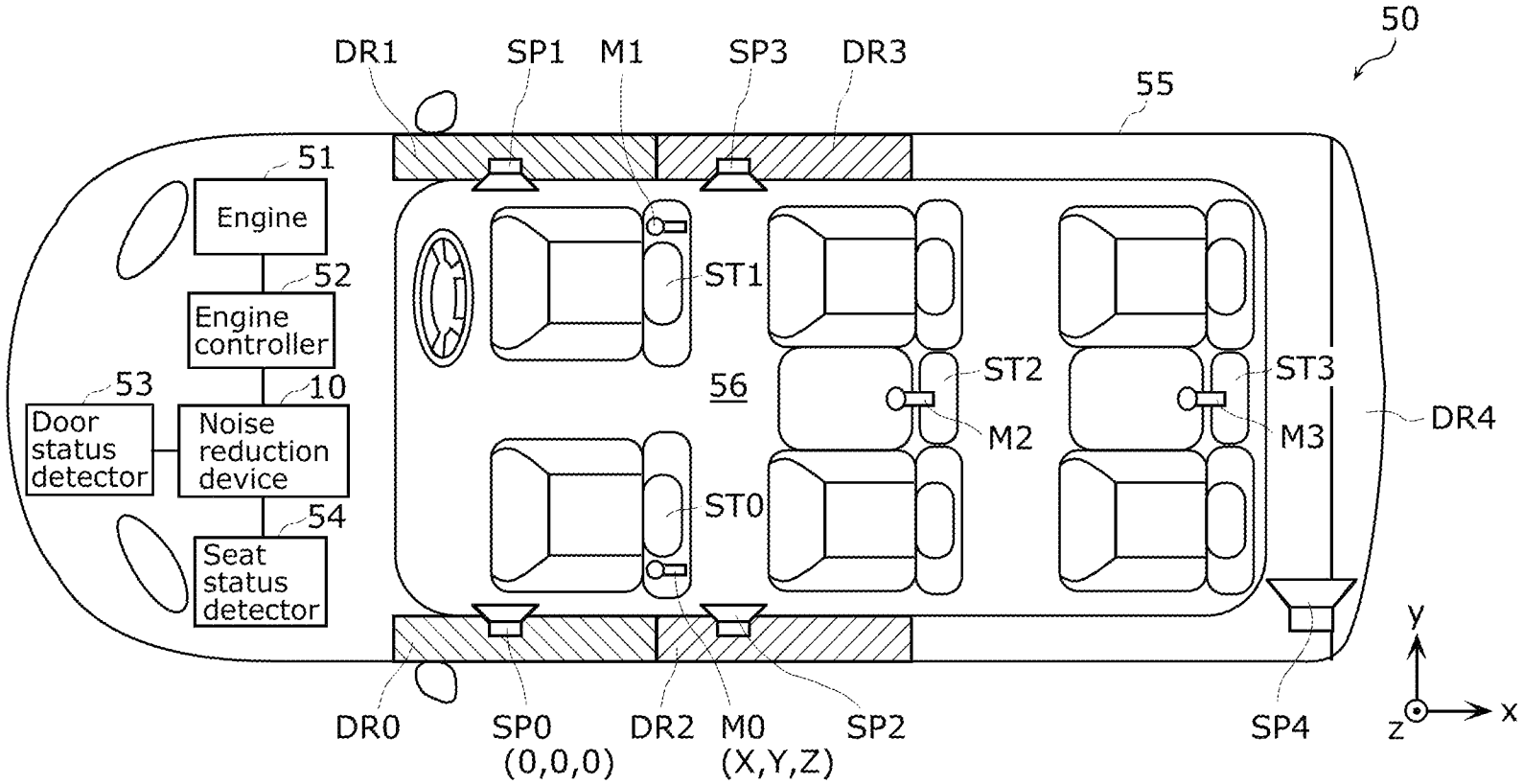
FIG. 3 schematically illustrates a vehicle provided with the noise reduction device according to Embodiment 1.

The following describes noise reduction device 10 in detail. In the present embodiment, noise reduction device 10 is installed in a vehicle as an example. FIG. 3 schematically illustrates the vehicle provided with noise reduction device 10.

Vehicle 50 is an example of a mobile apparatus, and includes noise reduction device 10, engine 51, engine controller 52, speakers SP0 to SP4, microphones M0 to M3, seats ST0 to ST3, seat status detector 54, vehicle body 55, doors DR0 to DR4, and door status detector 53. Although vehicle 50 is an automobile as a specific example, this is not intended to be limiting.

Engine 51 is a power source of vehicle 50 and also a drive system that is a noise source of space 56. Engine 51 is located in a space different from space 56, for example. To be more specific, engine 51 is disposed in a space formed in a hood of vehicle body 55.

Engine controller 52 controls (drives) engine 51 according to, for example, an accelerator operation performed by a driver of vehicle 50. Moreover, engine controller 52 outputs a pulse signal (an engine pulse signal) corresponding to the number of revolutions (a frequency) of engine 51, as a noise reference signal. The frequency of the pulse signal is proportional to the number of revolutions (the frequency) of engine 51, for example. More specifically, the pulse signal is a cancel signal of a top dead center (TDC) sensor or a so-called tacho pulse, for example. Here, the noise reference signal may be in any form that correlates with noise.

Each of speakers SP0 to SP4 is an example of a sound output unit and outputs a cancelling sound using a cancel signal. Speaker SP0 is attached to door DR0 on a passenger-seat (seat ST0) side on a front side. Speaker SP1 is attached to door DR1 on a driver-seat (seat ST1) side on the front side. Speaker SP2 is attached to door DR2 on the passenger-seat side on a rear side. Speaker SP3 is attached to door DR3 on the driver-seat side on the rear side. Speaker SP4 is a subwoofer, for example, and disposed near door DR4 that is a backdoor. Note that at least one speaker SP may be placed in space 56 and that the number of speakers SP is not particularly intended to be limiting.

Each of doors DR0 to DR4 is a structure that is opened or closed for listener 30 to come in or out of vehicle 50. Each of doors DR0 to DR4 is another example of a movable component provided for the vehicle.

Door status detector 53 detects a status for each of doors DR0 to DR4 and outputs a door status signal indicating the detected status. To be more specific, door status detector 53 detects an opened or closed status for each of doors DR0 to DR4 and outputs the door status signal indicating the detected opened or closed status. The door status signal indicates whether the door is opened or closed, and does not indicate, for example, an angle to which the door is opened. More specifically, the door status signal does not indicate a shift amount (such as an open angle) of the corresponding one of doors DR0 to DR4.

For example, door status detector 53 is a sensor module that senses the opened or closed status for each of doors DR0 to DR4. Here, a specific form of door status detector 53 is not particularly intended to be limiting. Note that door status detector 53 may detect the opened or closed status of at least one of doors DR0 to DR4 and output a status signal indicating a detection result.

Each of microphones M0 to M3 is an example of a sound collector and obtains a residual sound caused by interference of a cancelling sound and noise. Moreover, each of microphones M0 to M3 outputs an error signal based on the obtained residual sound. Microphone M0 is attached to a headrest of the passenger seat (seat ST0). Microphone M1 is attached to a headrest of the driver seat (seat ST1). Microphone M2 is attached to a headrest of seat ST2 in a second row. Microphone M3 is attached to a headrest of seat ST3 in a third row. Note that at least one microphone M may be placed in space 56 and that the number of microphones M is not particularly intended to be limiting.

Each of seats ST0 to ST3 is a place in which listener 30 is to be seated in vehicle 50. Each of seats ST0 to ST3 is an example of a movable component provided for vehicle 50. Each of seats ST0 to ST3 has a mechanism that allows a position of the seat to change in a front-back direction (or more specifically, allows the position to change in an X axis direction). Each of seats ST0 to ST3 may further has a mechanism that allows the position of the seat to change in a height direction (or more specifically, allows the position to change in a Z axis direction). Furthermore, each of seats ST0 to ST3 has a mechanism that allows an angle of a backrest to change with respect to a seating face.

Seat status detector 54 detects a status for each of seats ST0 to ST3 and outputs a seat status signal indicating the detected status. To be more specific, seat status detector 54 detects a position in the front-back direction and an angle of the backrest for each of seats ST0 to ST3, and outputs the seat status signal indicating the detected position in the front-back direction and the detected angle of the backrest. The seat status signal includes a shift amount (including the position in the front-back direction and the angle of the backrest) of the corresponding one of seats ST0 to ST3.

For example, seat status detector 54 is a sensor module that senses the position in the front-back direction and the angle of the backrest for each of seats ST0 to ST3. Here, a specific form of seat status detector 54 is not particularly intended to be limiting. Note that seat status detector 54 may detect at least one of the position or a posture of at least one of seats ST0 to ST3 and output a status signal indicating a detection result.

Vehicle body 55 is a structure including a chassis and a body of vehicle 50. Vehicle body 55 includes space 56 (a vehicle interior space) in which doors DR0 to DR4, speakers SP0 to SP4, and microphones M0 to M3 are disposed.

[Configuration and Basic Operation of Noise Reduction Device]

Figure 4A:
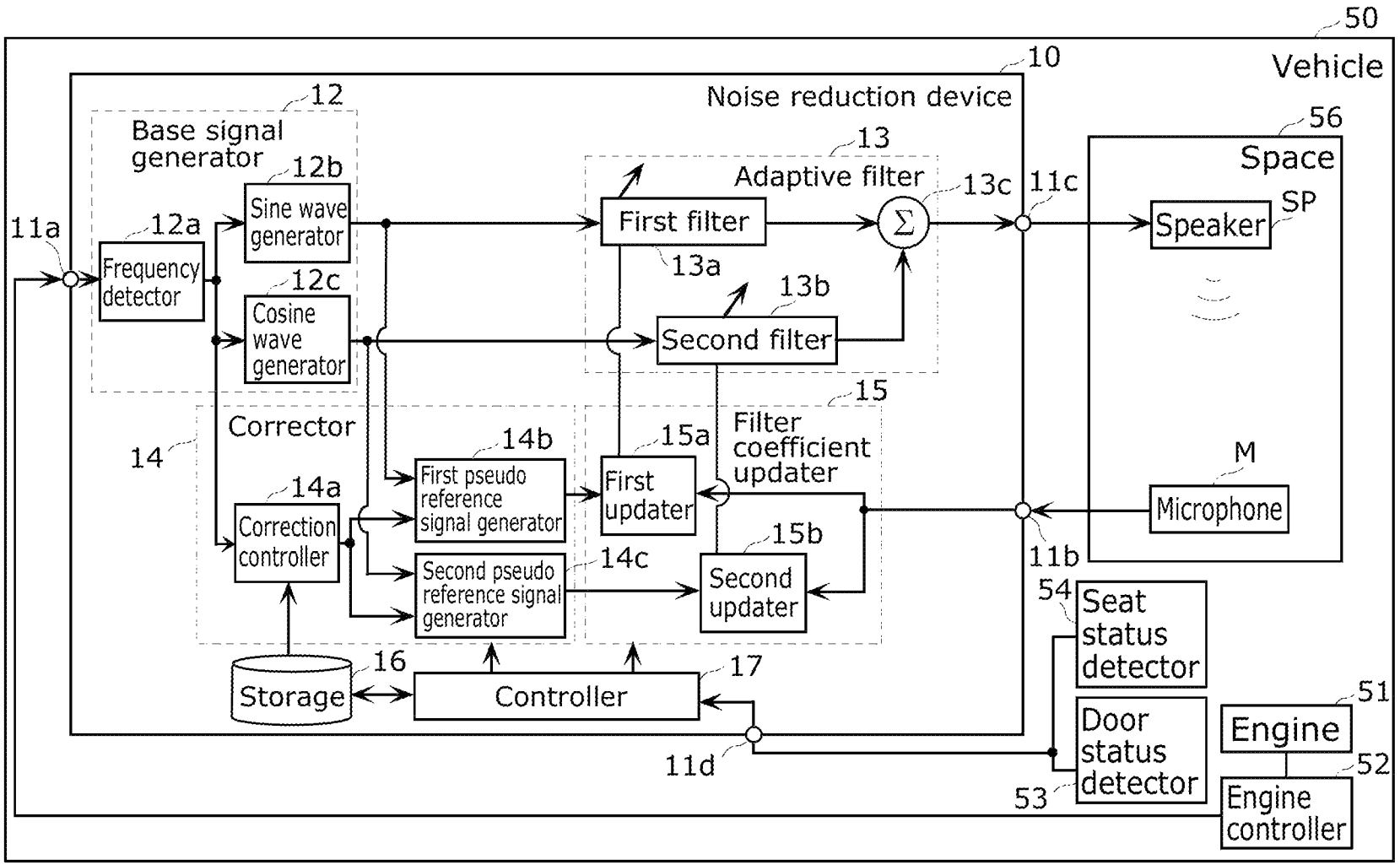
FIG. 4A is a functional block diagram of the noise reduction device according to Embodiment 1.
Figure 5:
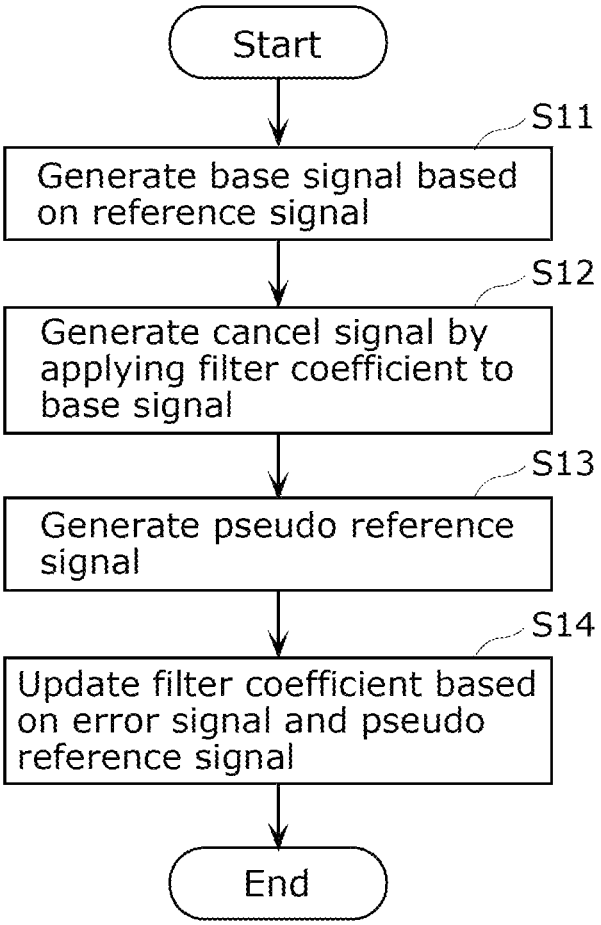
FIG. 5 is a flowchart of a basic operation performed by the noise reduction device according to Embodiment 1.

Next, a configuration and a basic operation of noise reduction device 10 are described. FIG. 4A is a functional block diagram of noise reduction device 10. FIG. 5 is a flowchart of the basic operation performed by noise reduction device 10.

Noise reduction device 10 is an active noise reduction device that uses a canceling sound from speaker SP to reduce noise heard at a position of microphone M.

FIG. 4A illustrates one speaker SP and one microphone M to simplify the description. Speaker SP in FIG. 4A corresponds to one of speakers SP0 to SP4 illustrated in FIG. 3. Microphone M in FIG. 4A corresponds to one of microphones M0 to M3 illustrated in FIG. 3. For example, if all of speakers SP0 to SP4 output canceling sounds based on error signals outputted from microphones M0 to M3, noise reduction device 10 includes as many configurations, one of which is illustrated in the block diagram of FIG. 4A, as the number obtained by multiplying the number of speakers SP0 to SP4 (five, for example) by the number of microphones M0 to M3 (four, for example). Here, at least one controller 17 may be shared in these configurations.

As illustrated in FIG. 4A, noise reduction device 10 includes reference signal input terminal 11*a*, base signal generator 12, adaptive filter applier 13, cancel signal output terminal 11*c*, corrector 14, error signal input terminal 11*b*, filter coefficient updater 15, storage 16, status signal input terminal 11*d*, and controller 17. Each of base signal generator 12, adaptive filter applier 13, corrector 14, filter coefficient updater 15, and controller 17 is implemented by a microcomputer, for example. However, each of these components may be implemented by a processor, such as a digital signal processor (DSP), or a dedicated circuit. Hereinafter, a relevant structural component is described in detail for each step of the flowchart of FIG. 5.

[Generation of Base Signal]

First, base signal generator 12 generates a base signal on the basis of a reference signal inputted to reference signal input terminal 11*a* (S11 in FIG. 5).

The reference signal correlating with noise is inputted to reference signal input terminal 11*a*. The reference signal is a pulse signal outputted from engine controller 52, for example.

More specifically, base signal generator 12 identifies an instantaneous frequency of the noise on the basis of the reference signal inputted to reference signal input terminal 11*a*. Then, base signal generator 12 generates a base signal having the identified frequency. To be more specific, base signal generator 12 includes frequency detector 12*a*, sine wave generator 12*b*, and cosine wave generator 12*c*.

Frequency detector 12*a* detects a frequency of the pulse signal, and outputs the detected frequency to sine wave generator 12*b*, cosine wave generator 12*c*, and correction controller 14*a* of corrector 14. In other words, frequency detector 12*a* identifies the instantaneous frequency of the noise.

Sine wave generator 12*b* outputs a sine wave having the frequency detected by frequency detector 12*a* as a first base signal. The first base signal is an example of the base signal. The first base signal is expressed as "$\sin(2\pi ft)=\sin(\omega t)$", where "f" represents the frequency detected by frequency detector 12*a*. More specifically, the first base signal has the frequency identified by frequency detector 12*a* (the same frequency as that of the noise). The first base signal is outputted to first filter 13*a* of adaptive filter applier 13 and to first pseudo reference signal generator 14*b* of corrector 14.

Cosine wave generator 12*c* outputs a cosine wave having the frequency detected by frequency detector 12*a* as a second base signal. The second base signal is an example of the base signal. The second base signal is expressed as "cos(2 πft)=cos(wt)", where "f" represents the frequency detected by frequency detector 12*a*. More specifically, the second base signal has the frequency identified by frequency detector 12*a* (the same frequency as that of the noise). The second base signal is outputted to second filter 13*b* of adaptive filter applier 13 and to second pseudo reference signal generator 14*c* of corrector 14.

[Generation of Cancel Signal]

Adaptive filter applier 13 generates a cancel signal by applying a filter coefficient to the base signal generated by base signal generator 12 (that is, by multiplying the base signal, which is generated by base signal generator 12, by a filter coefficient) (S12 in FIG. 5). More specifically, adaptive filter applier 13 applies the filter coefficient to the reference signal that is inputted to reference signal input terminal 11*a* and converted into the base signal. The cancel signal is used for outputting a canceling sound to reduce noise, and is outputted to cancel signal output terminal 11*c*. Adaptive filter applier 13 includes first filter 13*a*, second filter 13*b*, and adder 13*c*. Adaptive filter applier 13 is a so-called adaptive notch filter.

First filter 13*a* multiplies the first base signal outputted from sine wave generator 12*b* by a first filter coefficient. The first filter coefficient used in this multiplication corresponds to "A" in Equation 2 above and sequentially updated by first updater 15*a* of filter coefficient updater 15. A first cancel signal, which is the first base signal multiplied by the first filter coefficient, is outputted to adder 13*c*.

Second filter 13*b* multiplies the second base signal outputted from cosine wave generator 12*c* by a second filter coefficient. The second filter coefficient used in this multiplication corresponds to "B" in Equation 2 above and sequentially updated by second updater 15*b* of filter coefficient updater 15. A second cancel signal, which is the second base signal multiplied by the second filter coefficient, is outputted to adder 13*c*.

Adder 13*c* adds the first cancel signal outputted from first filter 13*a* to the second cancel signal outputted from second filter 13*b*. Adder 13*c* outputs a cancel signal, which is obtained by adding the first cancel signal to the second cancel signal, to cancel signal output terminal 11*c*.

Cancel signal output terminal 11*c* is made of a metal, for example. The cancel signal generated by adaptive filter applier 13 is outputted to cancel signal output terminal 11*c*. Cancel signal output terminal 11*c* is connected to speaker SP. Thus, the cancel signal is outputted to speaker SP via cancel signal output terminal 11*c*. Speaker SP outputs the cancelling sound based on the cancel signal.

[Generation of Pseudo Reference Signal]

Corrector 14 generates a pseudo reference signal by applying simulated transmission characteristic $C_1$ to the base signal. More specifically, corrector 14 generates a pseudo reference signal by correcting the base signal (S13 in FIG. 5). Corrector 14 includes correction controller 14*a*, first pseudo reference signal generator 14*b*, and second pseudo reference signal generator 14*c*.

Simulated transmission characteristic $C_1$ is obtained by simulating a path from the position of speaker SP to the position of microphone M. To be more specific, simulated transmission characteristic $C_1$ includes a gain and a phase (a phase lag) for each frequency. For example, simulated transmission characteristic $C_1$ is actually measured in space 56 previously and stored into storage 16. Thus, storage 16 stores a frequency in association with a gain and a phase for correcting a signal having this frequency.

Correction controller 14*a* obtains the frequency outputted from frequency detector 12*a* and reads the gain and phase corresponding to this obtained frequency. Moreover, correction controller 14*a* corrects the read phase according to an amount of correction calculated by correction controller 14*a*. Then, correction controller 14*a* outputs the read gain and the corrected phase.

First pseudo reference signal generator 14*b* generates a first pseudo reference signal by correcting the first base signal on the basis of the gain and phase outputted from correction controller 14*a*. The first pseudo reference signal is an example of the pseudo reference signal. The first pseudo reference signal is expressed as "γ·sin(ωt+φγ)", where "γ" represents the gain outputted from correction controller 14*a* and "φγ" represents the corrected phase. The generated first pseudo reference signal is outputted to first updater 15*a* of filter coefficient updater 15.

Second pseudo reference signal generator 14*c* generates a second pseudo reference signal by correcting the second base signal on the basis of the gain and phase outputted from correction controller 14*a*. The second pseudo reference signal is an example of the pseudo reference signal. The second pseudo reference signal is expressed as "δ·cos(ωt+φδ", where "δ" represents the gain outputted from correction controller 14*a* and "φδ" represents the corrected phase. The generated second pseudo reference signal is outputted to second updater 15*b* of filter coefficient updater 15.

Storage 16 is a storage device that stores simulated transmission characteristic $C_1$ obtained at a base temperature. Storage 16 stores a predetermined table or a predetermined correction formula for calculating the amount of correction and also stores a coefficient of the adaptive filter, for example. To be more specific, storage 16 is implemented by a semiconductor memory for instance. If noise reduction device 10 is implemented by a processor, such as a DSP, storage 16 also stores a control program executed by the processor. Storage 16 may store other parameters used for signal processing performed by noise reduction device 10.

[Update of Filter Coefficient]

Filter coefficient updater 15 sequentially updates the filter coefficient, on the basis of the error signal inputted to error signal input terminal 11*b* and the generated pseudo reference signal (S14 in FIG. 5).

Error signal input terminal 11*b* is made of a metal, for example. Error signal input terminal 11*b* receives the error signal based on the residual sound caused at the position of microphone M by interference of the cancelling sound and noise. The error signal is outputted from microphone M.

More specifically, filter coefficient updater 15 includes first updater 15*a* and second updater 15*b*.

First updater 15*a* calculates the first filter coefficient, on the basis of the first pseudo reference signal obtained from first pseudo reference signal generator 14*b* and the error signal obtained from microphone M. To be more specific, first updater 15*a* calculates the first filter coefficient to minimize the error signal according to the LMS algorithm, and outputs the calculated first filter coefficient to first filter 13*a*. Moreover, first updater 15*a* sequentially updates the first filter coefficient. First filter coefficient A (corresponding to "A" in Equation 2 above) is expressed by Equation 3 below, where "$r_1$" represents the first pseudo reference signal and "e" represents the error signal. Note that "n" is a positive integer and corresponds to a sampling count. Note also that "μ" represents a scalar, which is a step-size parameter determining an update amount of the filter coefficient per sampling.

[Math. 2]

$$A(n)=A(n-1)-\mu\cdot r_1(n)\cdot e(n) \quad \text{(Equation 3)}$$

Second updater 15*b* calculates the second filter coefficient, on the basis of the second pseudo reference signal obtained from second pseudo reference signal generator 14*c* and the error signal obtained from microphone M. To be more specific, second updater 15*b* calculates the second filter coefficient to minimize the error signal according to the LMS algorithm, and outputs the calculated second filter coefficient to second filter 13*b*. Moreover, second updater 15 sequentially updates the second filter coefficient. Second filter coefficient B (corresponding to "B" in Equation 2 above) is expressed by Equation 4 below, where "$r_2$" represents the second pseudo reference signal and "e" represents the error signal.

[Math. 3]

$$B(n)=B(n-1)-\mu\cdot r_2(n)\cdot e(n) \quad \text{(Equation 4)}$$

Here, cancel signal $out_d$ outputted from adder 13*c* is expressed by Equation 5 below, where $s_1$ represents the output from sine wave generator 12*b* and $s_2$ represents the output from cosine wave generator 12*c*.

[Math. 4]

$$out_d(n)=A(n)\cdot s_1(n)+B(n)\cdot s_2(n) \quad \text{(Equation 5)}$$

Figure 4B:
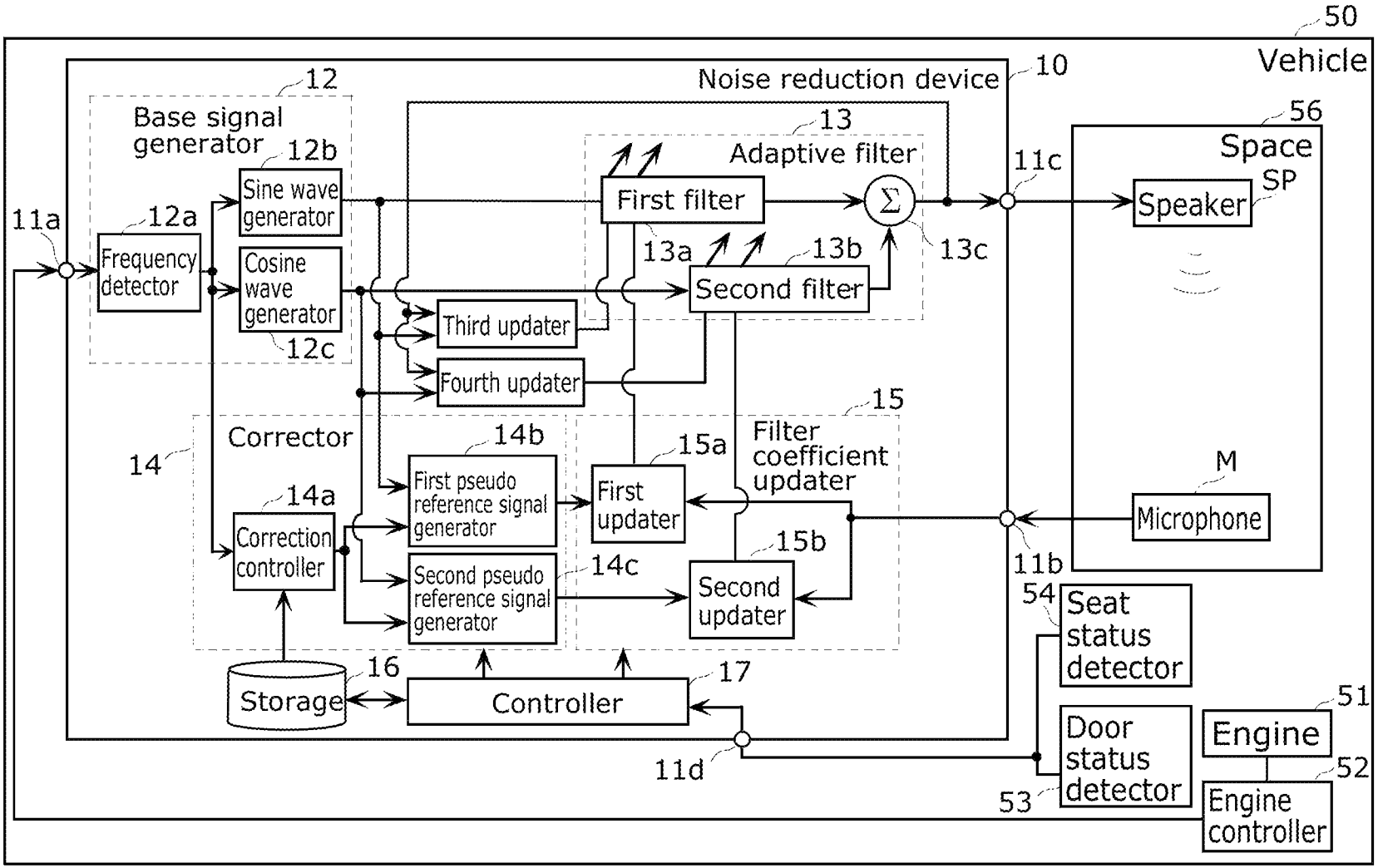
FIG. 4B is another functional block diagram of the noise reduction device according to Embodiment 1.

To stabilize noise control performed by noise reduction device 10, a third updater and a fourth updater that update the first filter coefficient and the second filter coefficient may be provided. FIG. 4B is a functional block diagram of noise reduction device 10 including the third updater and the fourth updater.

The third updater updates the first filter coefficient, on the basis of the output from sine wave generator 12*b* and a signal obtained by multiplying the output from adaptive filter applier 13 by a gain coefficient (hereinafter, referred to as the α coefficient). The fourth updater updates the second filter coefficient, on the basis of the output from cosine wave generator 12*c* and a signal obtained by multiplying the output from adaptive filter applier 13 by the α coefficient. Insertion of these filter coefficients updated by the third updater and the fourth updater into Equations 3 and 4 yields Equations 6 and 7 below.

[Math. 5]

$$A(n)=A(n-1)-\mu\cdot r_1(n)\cdot e(n)-\mu\cdot\alpha\cdot s_1(n)\cdot out_d(n) \quad \text{(Equation 6)}$$

$$B(n)=B(n-1)-\mu\cdot r_2(n)\cdot e(n)-\mu\cdot\alpha\cdot s_2(n)\cdot out_d(n) \quad \text{(Equation 7)}$$

Here, "α" represents the α coefficient. A rate of updating the filter coefficient using the cancel signal increases as the value of α increases. This enhances stability, but decreases noise-canceling effect. In practical use, an appropriate value is set in accordance with a noise status and a system in order to keep the stability and the noise-canceling effect in balance.

[Operation of Controller]

Noise reduction device 10 generates the cancel signal to output the canceling sound on the basis of the transmission characteristic from the position of the speaker to the position of the microphone. In this case, if the transmission characteristic changes due to, for example, a change in a positional relationship between the speaker and the microphone, the noise control becomes unstable. This may result in a phenomenon, such as an unusual noise.

For example, simulated transmission $C_1$ stored in storage 16 is created on a precondition that vehicle 50 is in a predetermined base status. In the base status, each of doors DR0 to DR4 is closed and each of seats ST0 to ST3 is in a default position with a default posture (angle). If microphone M is attached to seat ST as in vehicle 50 in particular, the positional relationship between microphone M and speaker SP changes in response to a change in the position or posture of seat ST. As a result, simulated transmission characteristic $C_1$ described above may not satisfactorily achieve noise reduction effect or may cause unstable control. Similarly, if any of doors DR0 to DR4 is opened, a transmission characteristic in space 56 of vehicle 50 changes. As a result, the noise reduction effect may not be satisfactorily achieved or the control may become unstable.

Figure 6:
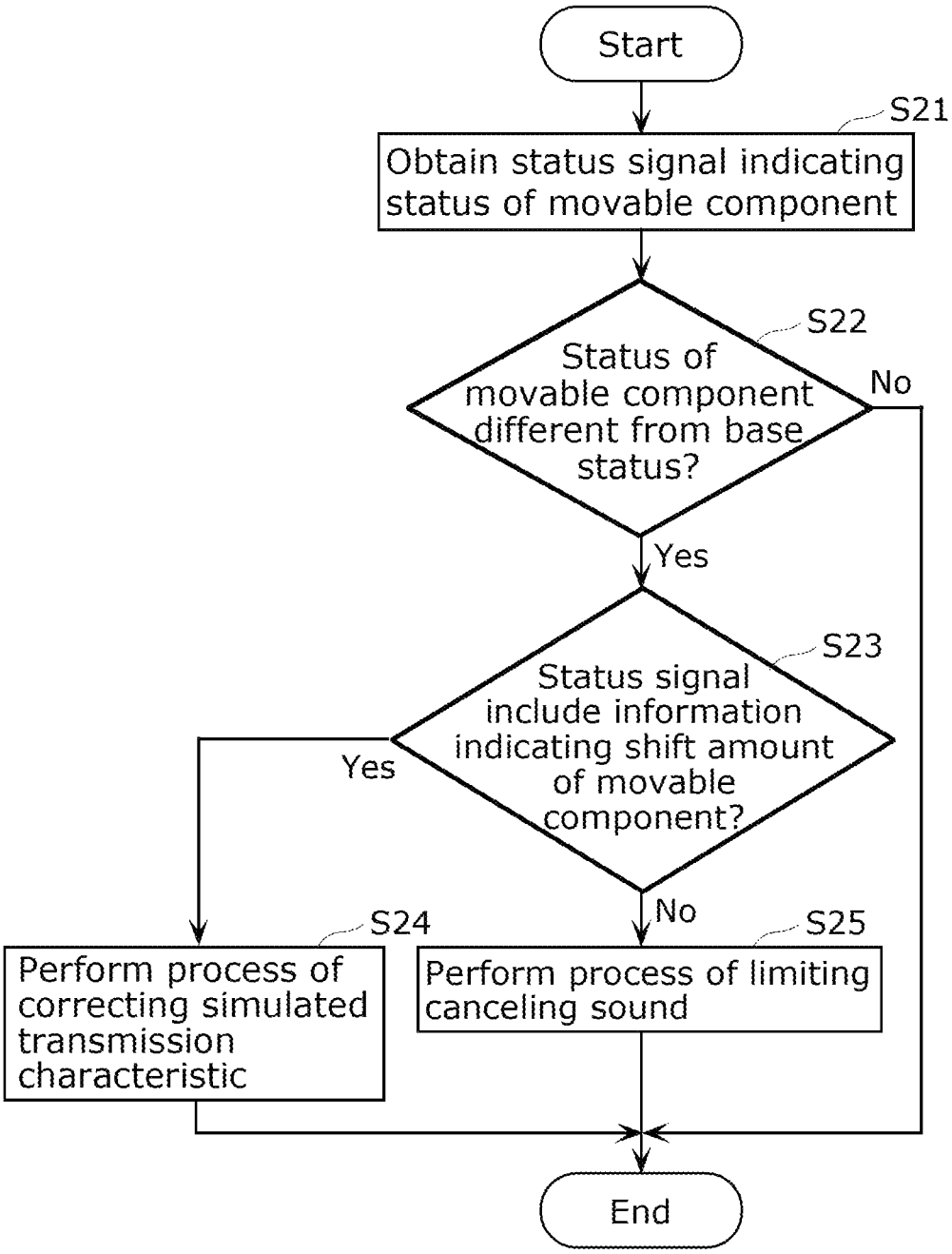
FIG. 6 is a flowchart of an operation performed by a controller included in the noise reduction device according to Embodiment 1.

In view of this, controller 17 changes control details on the output of the canceling sound, on the basis of a status signal inputted to status signal input terminal 11*d*. FIG. 6 is a flowchart of an operation performed by controller 17.

First, controller 17 obtains a status signal indicating a status of a movable component provided for vehicle 50, via status signal input terminal 11*d* (S21). Controller 17 obtains the status signal via a controller area network (CAN), for example. Here, the movable component may affect the transmission characteristic in space 56, and examples of such movable component include seats ST0 to ST3 and doors DR0 to DR4.

Next, controller 17 determines whether the status of the movable component indicated by the status signal obtained in Step S21 is different from the base status (S22). As described above, each of doors DR0 to DR4 is closed and each of seats ST0 to ST3 is in the default position with the default posture (angle) in the base status.

If the status of the movable component indicated by the status signal obtained in Step S21 is determined as being the same as the base status (No in S22), the operation ends here. If determining that the status of the movable component indicated by the status signal obtained in Step S21 is determined as being different from the base status (Yes in S22), controller 17 determines whether the status signal includes information indicating a shift amount of the movable component (S23). In the present embodiment, the status signal is the seat status signal outputted from seat status detector 54 or the door status signal outputted from door status detector 53. The seat status signal includes information indicating the position and posture of seat ST. However, the door status signal does not include information indicating the shift amount (angle) of the door. More specifically, the information indicating the shift amount of the movable component is included in the seat status signal, and is not included in the door status signal. Note that the seat status signal includes identification information of the corresponding seat ST, and that the door status signal includes identification information of the corresponding door DR.

If determining that the status signal includes the information indicating the shift amount of the movable component (or more specifically, if determining that at least one of the position or posture of seat ST changes) (Yes in S23), controller 17 performs a process for correcting simulated transmission characteristic $C_1$ (S24). In contrast, if determining that the status signal does not include the information indicating the shift amount of the movable component (or more specifically, if determining that one of doors DR0 to DR4 is opened) (No in S23), controller 17 performs a process for limiting the canceling sound (S25).

[Process for Correcting Simulated Transmission Characteristic]

The process for correcting simulated transmission characteristic $C_1$ in Step S24 is described in detail as follows. Simulated transmission characteristic $C_1$ is most appropriate when a first position of speaker SP and a second position of microphone M have a base positional relationship. However, if the first position of speaker SP and the second position of microphone M have a positional relationship other than the base positional relationship due to a change in the posture or position of seat ST, simulated transmission characteristic $C_1$ is not most appropriate. If the canceling sound based on simulated transmission characteristic $C_1$ is outputted even when the first position of speaker SP and the second position of microphone M have the positional relationship other than the base positional relationship, the noise reduction effect may not be achieved satisfactorily.

In view of this, controller 17 of noise reduction device 10 performs the process for correcting simulated transmission characteristic $C_1$ (also referred to as first transmission characteristic $C_1$ in the section of "Process for Correcting Simulated Transmission Characteristic") read from storage 16. The following describes an example in which controller 17 corrects first transmission characteristic $C_1$ in accordance with a distance between the first position of speaker SP0 and the second position of microphone M0. Here, this process is similarly performed for other speakers SP and other microphones M.

Suppose that seat ST0 provided with microphone M0 is in the base status, that microphone M0 is in the base position, and that the first and second positions have the base positional relationship. In this case, first distance D1 between the first position and the second position is expressed by Equation 8 below, where "(0, 0, 0)" represents coordinates of the first position and "(X, Y, Z)" represents coordinates of the second position. The coordinates are illustrated in FIG. 3 described above.

[Math. 6]

$$D1=\sqrt{X^2+Y^2+Z^2} \quad \text{(Equation 8)}$$

Figure 7:
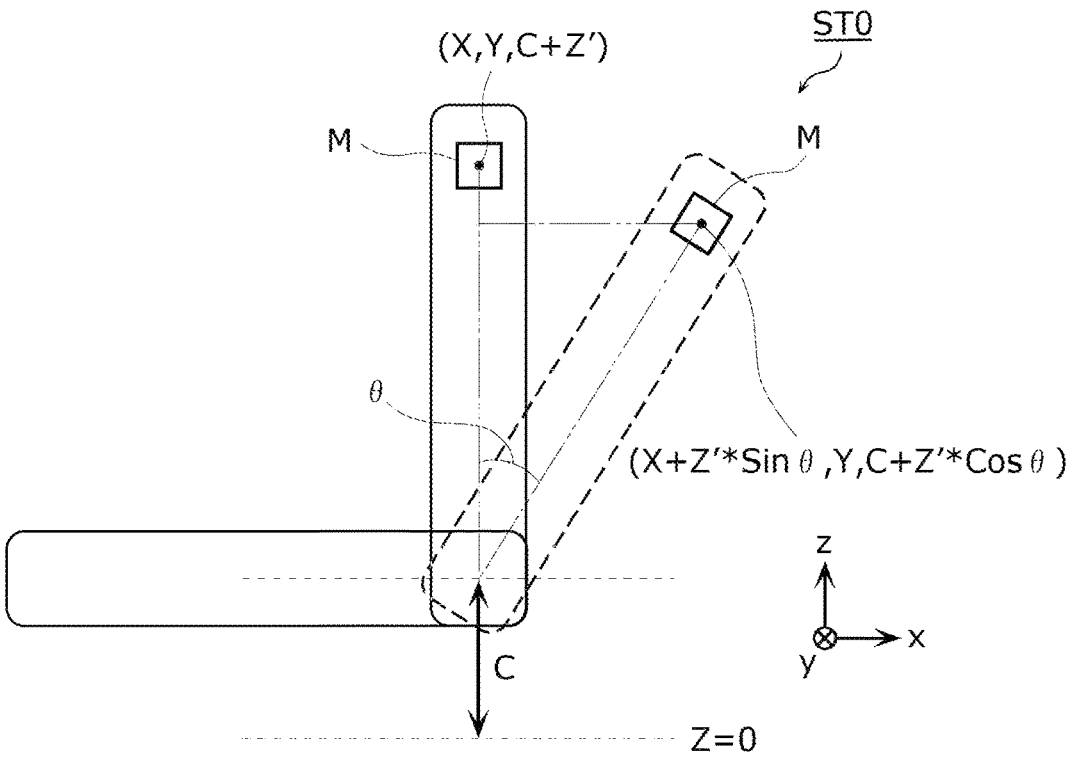
FIG. 7 illustrates coordinates of a second position when a backrest of a seat inclines with respect to a seating face.

When the backrest of seat ST0 inclines θ degrees from the base status in which the backrest forms a 90-degree angle with the seating face, the coordinates of the second position are calculated as illustrated in FIG. 7. FIG. 7 illustrates the coordinates of the second position when the backrest of seat ST inclines with respect to the seating face.

To simplify calculation in the present embodiment, "Z" is expressed as "C+Z'", where a distance from a position, at which Z=0, to a rotation center of the backrest is "C", as illustrated in FIG. 7. To be more specific, when the first position and the second position have the base positional relationship, the coordinates of the second position is expressed as "(X, Y, C+Z')" and first distance D1 is expressed by Equation 9 below.

[Math. 7]

$$D1=\sqrt{X^2+Y^2+(C+Z')^2} \quad \text{(Equation 9)}$$

As illustrated in FIG. 7, when the backrest of seat ST0 inclines θ degrees from the base status, the coordinates of the second position are expressed as "(X+Z' sin θ, Y, C+Z' cos θ)".

Figure 8:
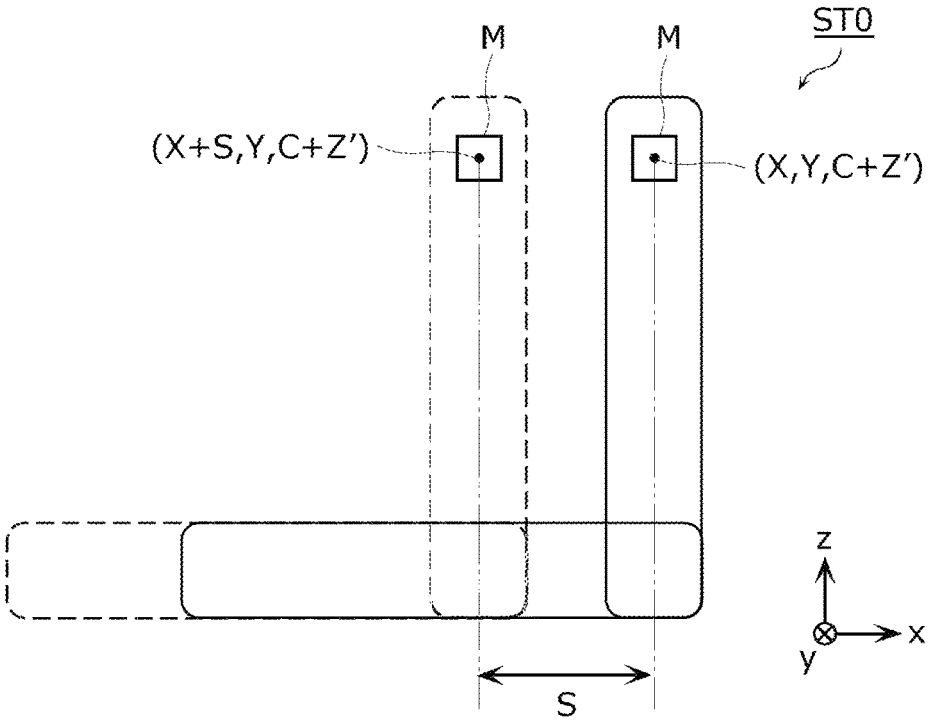
FIG. 8 illustrates coordinates of the second position when a position of the seat is shifted in a front-back direction.

FIG. 8 illustrates the coordinates of the second position when the position of seat ST0 is shifted by shift amount S in the front-back direction (or more specifically, the X axis direction). In this case, the coordinates of the second position are expressed as "(X+S, Y, C+Z')".

Thus, when the backrest of seat ST0 inclines θ degrees from the base status and the position of seat ST0 is shifted by shift amount S in the front-back direction (or more specifically, the X axis direction), the coordinates of the second position are expressed as "(X+Z' sin θ+S, Y, C+Z' cos θ)". In this case, distance D2 between the first position and the second position is expressed by Equation 10 below.

[Math. 8]

$$D2=\sqrt{(X+Z'\sin\theta+S)^2+Y^2+(C+Z'\cos\theta)^2} \quad \text{(Equation 10)}$$

Figure 9:
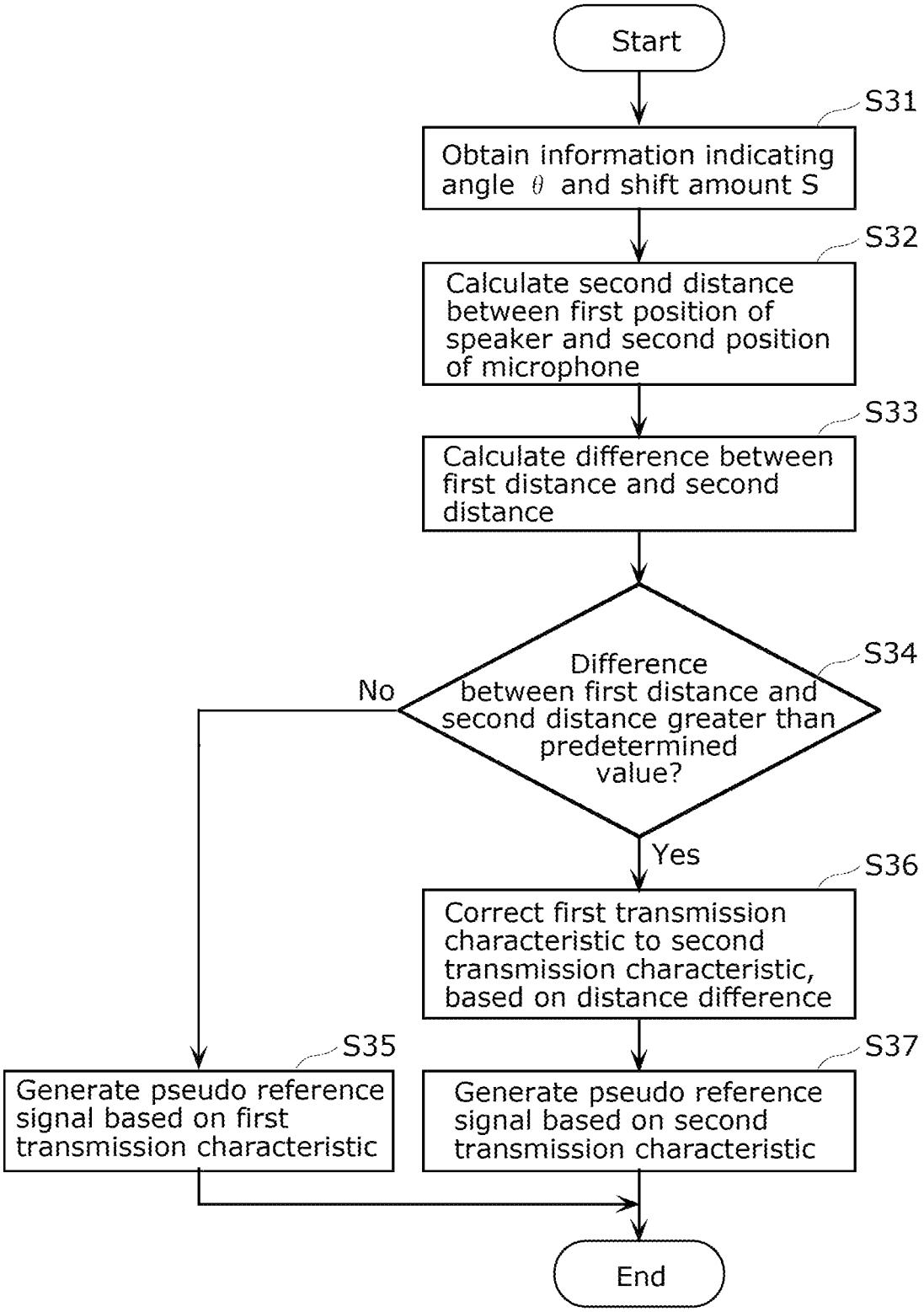
FIG. 9 is a flowchart of a process for correcting simulated transmission characteristic (first transmission characteristic).

Controller 17 calculates this second distance D2 and corrects first transmission characteristic $C_1$ to second transmission characteristic $C_2$ on the basis of calculated second distance D2. FIG. 9 is a flowchart of the process for correcting first transmission characteristic $C_1$.

First, controller 17 obtains information indicating angle θ and shift amount S from the status signal obtained in Step S21 of FIG. 6 (S31).

Next, controller 17 identifies angle θ and shift amount S from the signal indicating angle θ and shift amount S, and calculates second distance D2 between the first position of speaker SP0 and the second position of microphone M according to Equation 10 above (S32). Following this, controller 17 calculates a difference between first distance D1, which is the distance when the first position and the second position are in the base positional relationship, and calculated distance D2 (S33). Then, controller 17 determines whether the calculated difference is greater than a predetermined value (S34). Here, the difference between first distance D1 and second distance D2 is an absolute value of the difference between first distance D1 and second distance D2, for example. The predetermined value is greater than 0, for example.

If the difference between first distance D1 and second distance D2 is determined as being smaller than the predetermined value (No in S34) and the canceling sound based on first transmission characteristic $C_1$ without correction is outputted, the noise reduction effect can be achieved to some extent. On this account, controller 17 causes corrector 14 to generate a pseudo reference signal based on first transmission characteristic $C_1$ (S35). To be more specific, corrector 14 generates the pseudo reference signal using first transmission characteristic $C_1$ stored in storage 16, without correcting first transmission characteristic $C_1$.

In contrast, if the difference between first distance D1 and second distance D2 is determined as being greater than or equal to the predetermined value (Yes in S34) and the canceling sound based on first transmission characteristic $C_1$ without correction is outputted, the noise reduction effect may not be achieved satisfactorily. On this account, controller 17 corrects first transmission characteristic $C_1$ to second transmission characteristic $C_2$ (S36). Then, controller 17 causes corrector 14 to generate a pseudo reference signal based on second transmission characteristic $C_2$ (S37).

To be more specific, controller 17 corrects first transmission characteristic $C_1$ to second transmission characteristic $C_2$ by changing a phase correction amount for first transmission characteristic $C_1$ according to the difference between first distance D1 and second distance D2. For example, suppose that a predetermined phase correction amount for first transmission characteristic $C_1$ is Φ1 for a 200-Hz base signal. In this case, first transmission characteristic $C_1$ is corrected to second transmission characteristic $C_2$ by changing phase correction amount Φ1 for first transmission characteristic $C_1$ to "Φ1+ΔΦ1". More specifically, phase correction amount Φ2 for second transmission characteristic $C_2$ is "Φ1+ΔΦ1" for a 200-Hz base signal.

Here, phase difference ΔΦ1 is calculated as follows. If the first position and the second position have the base positional relationship, required time t1 for the canceling sound to reach the second position is "D1/340" based on a sound speed of 340 (m/s). In contrast, when the backrest of seat ST0 inclines θ degrees from the base status and the position of seat ST0 is shifted by shift amount S in the front-back direction, required time t2 for the canceling sound to reach the second position is "D2/340".

In this case, phase difference ΔΦ1 is expressed by Equation 11 below. In Equation 11, "f" represents a frequency of the base signal.

[Math. 9]

$$\Delta\phi 1 = 2\pi f(-(t2 - t1)) = \frac{20\pi}{17}(-D2 + D1) \quad \text{(Equation 11)}$$

As described above, controller 17 corrects first transmission characteristic $C_1$, which is used for updating the filter coefficient, on the basis of the shift amount (shift amount S and angle θ) in Step S24. Controller 17 corrects first transmission characteristic $C_1$ read from storage 16 to second transmission characteristic $C_2$, and then corrector 14 generates the pseudo reference signal based on second transmission characteristic $C_2$. In this case, the noise reduction effect can be achieved even if the second position is significantly shifted from the base position. A plurality of transmission characteristics may be previously stored in storage 16 so that these transmission characteristics are selectively used according to a change in the positional relationship between the first position and the second position. In this case, an enormous amount of data on transmission characteristics are required. As compared to this case, however, a storage capacity required of storage 16 in noise reduction device 10 can be reduced.

[Variations of Process for Correcting Simulated Transmission Characteristic]

The operation described with reference to the flowchart in FIG. 9 is an example. For example, controller 17 calculates second distance D2 in Step S22, and then calculates the difference between first distance D1 and second distance D2 in Step S23. However, controller 17 may identify the difference between first distance D1 and second distance D2 by reference to information (such as table information) that is previously stored in storage 16 and that associates angle θ and shift amount S with the difference of when seat ST0 has these angle θ and shift amount S. To be more specific, the difference between first distance D1 and second distance D2 is not necessarily required to be calculated.

Furthermore, phase difference ΔΦ01 may also be identified by reference to information stored in storage 16. For example, storage 16 may previously store information (such as table information) that associates difference X between first distance D1 and second distance D2 with phase correction coefficient p (X). In this case, controller 17 is able to identify a phase correction coefficient corresponding to difference X between first distance D1 and second distance D2 and calculate phase difference ΔΦ1 according to Equation 12 below. Here, correction amount Φ2 is calculated according to Equation 13 below.

[Math. 10]

$$\Delta\phi 1 = p(X) \cdot f \quad \text{(Equation 12)}$$

$$\phi 2 = \phi 1 + p(X) \cdot f \quad \text{(Equation 13)}$$

In this way, such reference to the information previously stored in storage 16 can reduce an amount of calculation in the process for correcting simulated transmission characteristic $C_1$. Moreover, a storage capacity required of storage 16 can be reduced as compared to the case where storage 16 stores a plurality of simulated transmission characteristics.

In the above embodiment, the phase correction amount for simulated transmission characteristic $C_1$ is changed. However, a gain correction amount for simulated transmission characteristic $C_1$ may be changed. Furthermore, in the above embodiment, simulated transmission characteristic $C_1$ is corrected on the basis of the difference between first distance D1 and second distance D2. However, simulated transmission characteristic $C_1$ may be corrected on the basis of only second distance D2. To be more specific, simulated transmission characteristic $C_1$ may be corrected on the basis of information that associates second distance D2 with a phase correction coefficient, for example.

If noise reduction device 10 includes the third updater and the fourth updater (see FIG. 4B), the step-size parameter or the α coefficient may be changed in addition to the process for correcting simulated transmission characteristic $C_1$. For example, controller 17 may reduce a value of the step-size parameter of when the first position of speaker SP and the second position of microphone M are not in the base positional relationship so that this value is smaller than (for example, half as small as) a value of the step-size parameter of when the first position and the second position have the base positional relationship. Moreover, controller 17 may increase a value of the α coefficient of when the first position of speaker SP and the second position of microphone M are not in the base positional relationship so that this value is larger than (for example, twice as large as) a value of the α coefficient of when the first position and the second position are in the base positional relationship.

Such change in the step-size parameter or the α coefficient in addition to the process for correcting simulated transmission characteristic $C_1$ can achieve the noise-canceling effect or adjust the stability. Thus, even with the reduced amount of calculation, the function can be maintained. These values may be changed in proportion to the shift amount, or may be changed by reference to a data table that is previously stored in association with the shift amount. An amount of value change depends on a noise status and a system configuration.

In the above embodiment, the first position of speaker SP is fixed and the second position of microphone M is to be shifted. However, the first position of speaker SP may be shifted and the second position of microphone M may be fixed. For example, speaker SP may be attached to the seat and microphone M may be attached to a dashboard for instance. Moreover, both the first position of speaker SP and the second position of microphone M may be shifted.

Furthermore, at least either one of speaker SP or microphone M may be attached to a place other than seat ST. For example, at least either one of speaker SP or microphone M may be attached to a structure that changes in at least one of position or posture in response to, for example, a user operation.

[First Example of Process for Limiting Canceling Sound]

The following describes in detail the process for limiting the cancelling sound in Step S25. When at least one of doors DR0 to DR4 is opened, the position of speaker SP attached to this door changes. However, the door status signal indicating the status of the door does not include the shift amount of the door (such as an open amount, or more specifically, an open angle of the door). For this reason, when the door is opened, it is difficult to correct the transmission characteristic according to the method used when seat ST is shifted. Thus, controller 17 performs the process for limiting the canceling sound when the door is opened.

When doors in the second row (door DR2 and door DR3) of vehicle 50, which is used in a study by the inventors, are opened, change is small in the transmission characteristics from the door speakers in the first row (speaker SP0 and speaker SP1) to the microphones in the first row (microphone M0 and microphone M1). Thus, when the doors in the second row (DR2 and DR3) are opened, the canceling sound is outputted from the door speakers in the first row (speaker SP0 and speaker SP1) without concern.

In contrast, when the doors in the second row (door DR2 and door DR3) are opened, change is large in the transmission characteristics from the door speakers in the second row (speaker SP2 and speaker SP3) to the microphone in the second row (microphone M2). Thus, when the doors in the second row (door DR2 and door DR3) are opened, the canceling sounds outputted from the door speakers in the second row (speaker SP2 and speaker SP3) may not satisfactorily reduce the noise or may unfortunately become abnormal noises.

When the backdoor (door DR4) is opened, change is small in the transmission characteristic from speaker SP4 to the microphone in the second row (microphone M2) and change is large in the transmission characteristic from speaker SP4 to the microphone in the third row (microphone M3). Thus, when the backdoor (door DR4) is opened, the canceling sound outputted from speaker SP4 may not satisfactorily reduce the noise or may unfortunately become an abnormal noise.

Figure 10:
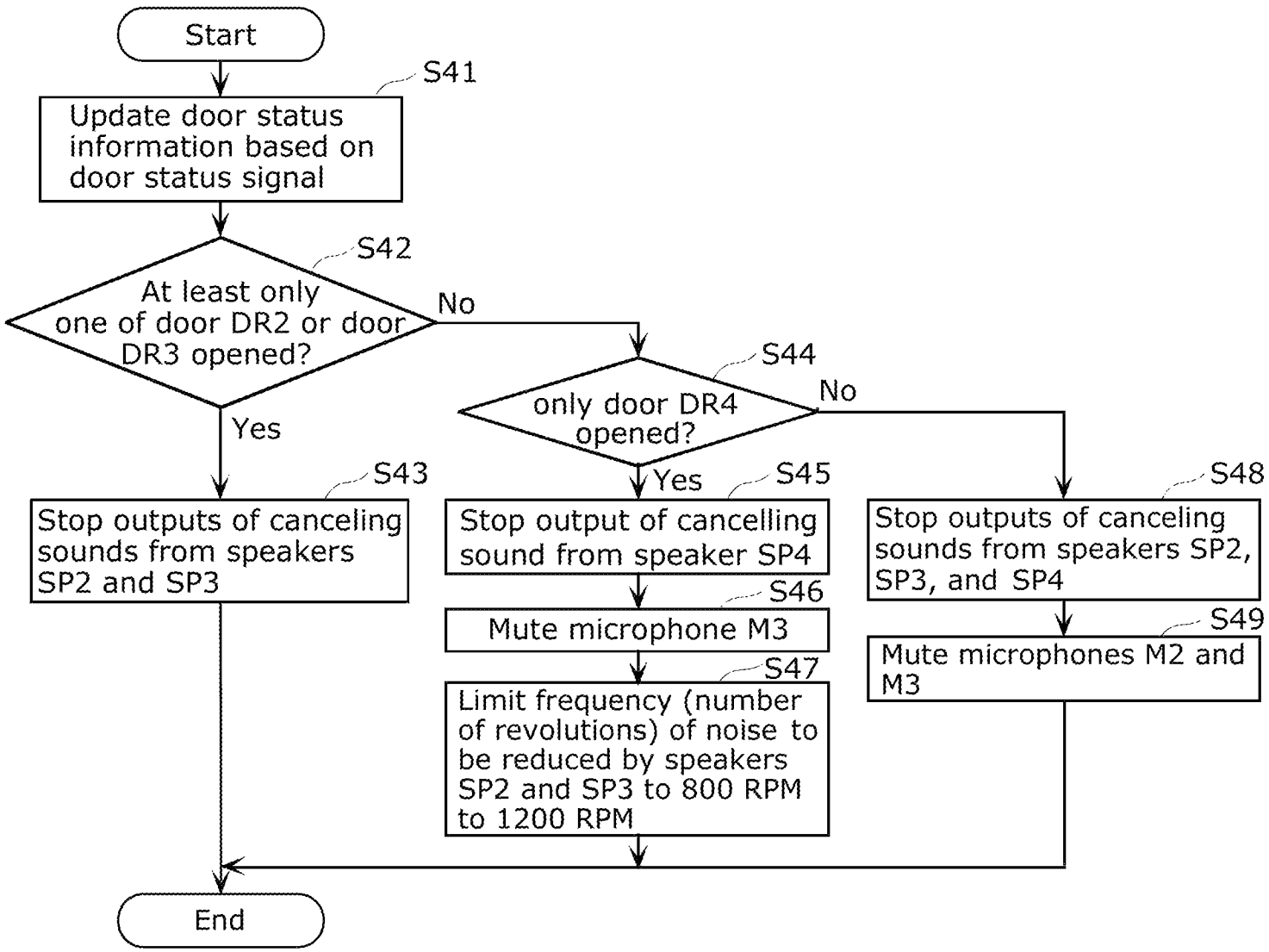
FIG. 10 is a flowchart according to a first example of a process for limiting a cancelling sound.

On the basis of knowledge as described above, the process found by the inventors to limit the canceling sound is described. FIG. 10 is a flowchart according to a first example of the process for limiting the cancelling sound. The example in FIG. 10 describes a process for controlling the speakers and microphones other than the door speakers in the first row and the microphones in the first row. Note that, however, when the door in the first row is opened, a process for completely stopping the control (the output of the canceling sound) may be performed for instance because, in this case, change is significant in the transmission characteristics for all the seats. In the following description with reference to FIG. 10, a door status signal includes door identification information (to indicate the status of which one of doors DR0 to DR4 is included in the present door status signal).

When obtaining a door status signal, controller 17 updates door status information stored in storage 16 on the basis of the obtained door status signal (S41). The door status information (such as table information) indicates for each of doors DR0 to DR4 whether the door is opened or closed. The door status information is updated whenever the door status signal (or more specifically, the door status signal including the door identification information) is obtained.

Next, controller 17 determines whether at least only one of door DR2 or door DR3 among doors DR2 to DR4 is currently opened, by reference to the door status information stored in storage 16 (S42). If determining that only one of door DR2 and door DR3 is currently opened (Yes in S42), controller 17 stops the outputs of the canceling sounds from speakers SP2 and SP3 (S43). More specifically, controller 17 deactivates adaptive filter applier 13 that outputs the canceling sound to speakers SP2 and SP3, by controlling filter coefficient updater 15 that updates the filter coefficient of adaptive filter applier 13. Here, controller 17 may use any method to stop the outputs of the canceling sounds from speakers SP2 and SP3.

If determining that the currently-opened door is not at least only one of door DR2 or door DR3 (No in S42), controller 17 determines whether only door DR4 among doors DR2 to DR4 is currently opened (S44).

If determining that only door DR4 is currently opened (Yes in S44), controller 17 stops the output of the cancelling sound from speaker SP4 (S45). More specifically, controller 17 deactivates adaptive filter applier 13 that outputs the canceling sound to speaker SP4, by controlling filter coefficient updater 15 that updates the filter coefficient of adaptive filter applier 13. Here, controller 17 may use any method to stop the output of the canceling sound from speaker SP4.

Moreover, controller 17 mutes an error signal from microphone M3 (S46). More specifically, controller 17 disables (mutes) the error signal from microphone M3 by controlling adaptive filter applier 13 that obtains the error signal from microphone M3. Here, controller 17 may use any method to mute the error signal from microphone M3.

Furthermore, controller 17 limits a frequency range, which is to be reduced by the cancelling sounds from speaker SP2 and SP3, to a range corresponding to 800 rpm to 1200 rpm representing the number of revolutions of engine 51 (S47). More specifically, controller 17 monitors the frequency of noise detected by frequency detector 12*a*. If the frequency of noise in terms of revolutions per minute corresponds to a value smaller than 800 rpm or greater than 1200 rpm, controller 17 stops the outputs of the cancelling sounds from speakers SP2 and SP3. If the frequency of noise in terms of revolutions per minute corresponds to a value from 800 rpm to 1200 rpm, controller 17 causes the cancelling sounds to be normally outputted from speakers SP2 and SP3. Here, controller 17 may use any method to limit the frequency of noise that is to be reduced.

In contrast, if determining in Step S44 that the currently-opened door is not only door DR4 (No in S44), controller 17 stops the outputs of the cancelling sounds from speakers SP2, SP3, and SP4 (S48). Moreover, controller 17 mutes the error signals from microphones M2 and M3 (S49). The output of the cancelling sound is stopped as described above, and the error signal is muted as described above.

As described above, controller 17 performs, in Step S25: control to stop the output of the cancelling sound from the speaker; control to mute the error signal from the microphone; and control to limit the frequency range to be reduced by the cancelling sound. This prevents a risk that the noise reduction effect may be unsatisfactory and that the cancelling sound itself may become an abnormal noise.

[Second Example of Process for Limiting Canceling Sound]

Figure 11:
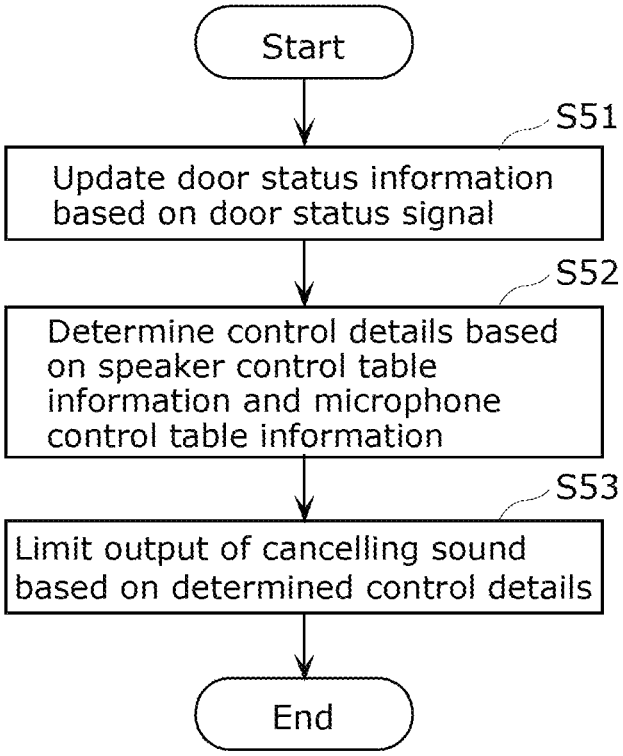
FIG. 11 is a flowchart according to a second example of the process for limiting the cancelling sound.

The process for limiting the cancelling sound in Step S25 may be performed using table information (or more specifically, a control matrix). FIG. 11 is a flowchart according to the second example of the process for limiting the cancelling sound. FIG. 12 illustrates a first example of speaker control table information. FIG. 13 illustrates a first example of microphone control table information. The speaker control table information and the microphone control table information are previously stored in storage 16.

When obtaining a door status signal, controller 17 updates the door status information stored in storage 16 on the basis of the obtained door status signal (S51).

Next, controller 17 determines control details on the basis of the speaker control table information and the microphone control table information in addition to the updated door status information (S52). As illustrated in FIG. 12, the first example of the speaker control table information indicates whether to activate or deactivate speakers SP0 to SP4, for each door status (or more specifically, for each identification information piece of an opened door). As illustrated in FIG. 13, the first example of the microphone control table information indicates whether to activate or deactivate microphones M0 to M3, for each door status. Here, when speaker SP is deactivated, this means that the output of the cancelling sound from speaker SP is stopped. When microphone M is deactivated, this means that the error signal from microphone M is disabled (muted). The output of the cancelling sound from speaker SP is stopped as described above, and microphone M is deactivated as described above.

For example, suppose that the door status information indicates that only door DR0 among five doors DR0 to DR4 is opened. In this case, controller 17 determines control details so that: only speakers SP0 and SP1 among speakers SP0 to SP4 are deactivated; and only microphones M0 and M1 among microphones M0 to M3 are deactivated.

Moreover, suppose that the door status information indicates that only doors DR1 and DR2 among the five doors are opened. In this case, controller 17 determines control details so that: speakers SP0 to SP3 are deactivated and only speaker SP4 is activated; and microphones M0 to M2 are deactivated and only microphone M3 is activated. Then, controller 17 limits the outputs of the cancelling sounds on the basis of the control details determined in Step S52 (S53). In other words, controller 17 performs the control as determined.

As described above, controller 17 determines which one of speakers SP0 to SP4 is to be deactivated to stop the cancelling sound and which one of microphones M0 to M3 is to be deactivated to mute the error signal, on the basis of the door status information (or more specifically, the door status signal including the door identification information) and the table information. Such determination of the control details by reference to the speaker control table information and the microphone control table information simplifies an algorithm for determining the control details. This reduces a storage capacity required of storage 16 and also reduces a processing load.

[Third Example of Process for Limiting Canceling Sound]

In the flowchart of FIG. 11 described above, table information illustrated in FIG. 14 and FIG. 15 may be used instead of the table information illustrated in FIG. 12 and FIG. 13. FIG. 14 illustrates a second example of the speaker control table information. FIG. 15 illustrates a second example of the microphone control table information.

As illustrated FIG. 14, the second example of the speaker control table information indicates a frequency range (that is, a frequency range of control) in which speakers SP0 to SP4 are to be deactivated, for each door status. As illustrated in FIG. 15, the second example of the microphone control table information indicates a frequency range (that is, a frequency range of control) in which microphones M0 to M3 are to be deactivated, for each door status. Note that noise reduction device 10 according to the present embodiment reduces noise with frequencies from 1 Hz to 300 Hz. Columns showing the frequencies from 1 Hz to 300 Hz in the table information substantially indicate deactivation.

For example, suppose that the door status information indicates that door DR0 among five doors DR0 to DR4 is opened. In this case, controller 17 deactivates only speakers SP0 and SP1 among speakers SP0 to SP4 and also deactivates only microphones M0 and M1 among microphones M0 to M3. Moreover, controller 17 deactivates microphone M2 if the frequency of noise is from 1 Hz to 70 Hz, and deactivates microphone M3 if the frequency of noise is from 1 Hz to 60 Hz. To be more specific, microphone M2 is normally activated if the frequency of noise is higher than 70 Hz, and microphone M3 is normally activated if the frequency of noise is higher than 60 Hz.

Moreover, suppose that the door status information indicates that doors DR1 and DR2 among five doors DR0 to DR4 are opened. In this case, controller 17 determines control details so that: speakers SP0 to SP3 are deactivated and only speaker SP4 is activated; and microphones M0 to M2 are deactivated and only microphone M3 is activated. Moreover, controller 17 deactivates speaker SP4 if the frequency of noise is from 65 Hz to 100 Hz. The speaker SP is normally activated if the frequency of noise is lower than 65 Hz or higher than 100 Hz.

As described above, by reference to the door status information (or more specifically, the door status signal including the door identification information) and the table information, controller 17 deactivates at least one of speakers SP0 to SP4 and at least one of microphones M0 to M3 if the frequency of noise is defined (i.e., predetermined) in the table information. Such limitation on the frequency range by reference to the speaker control table information and the microphone control table information simplifies an algorithm used by noise reduction device 10 and also enables noise reduction device 10 to determine the control details more thoroughly. Note that the range indicated in the table information of FIG. 14 and FIG. 15 where speaker SP or microphone M is deactivated may be specified by the number of revolutions instead of the frequency.

[Fourth Example of Process for Limiting Canceling Sound]

Figure 16:
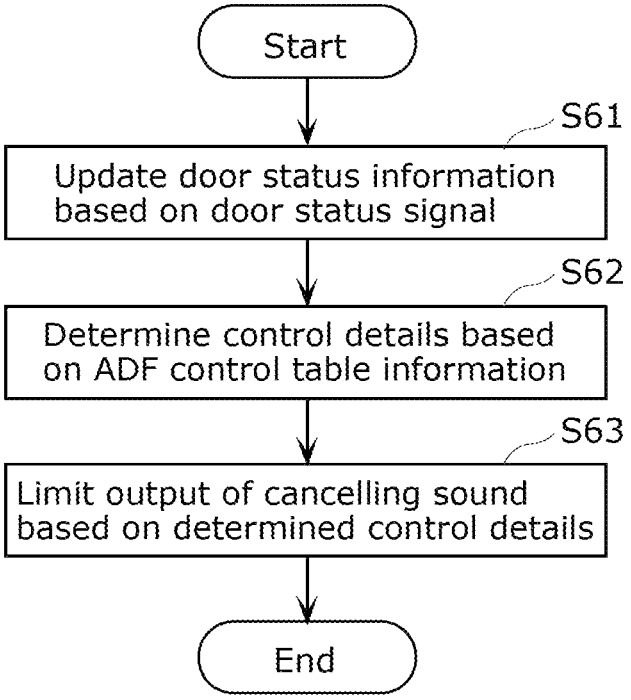
FIG. 16 is a flowchart according to a fourth example of the process for limiting the cancelling sound.

The process for limiting the cancelling sound in Step S25 may be performed using ADF (that is, adaptive filter applier 13 and filter coefficient updater 15) control table information. FIG. 16 is a flowchart according to the fourth example of the process for limiting the cancelling sound. FIG. 17 illustrates an example of the ADF control table information. The ADF control table information is previously stored in storage 16.

When obtaining a door status signal, controller 17 updates the door status information stored in storage 16 on the basis of the obtained door status signal (S61).

Next, controller 17 determines control details on the basis of the ADF control table information in addition to the updated door status information (S62). As illustrated in FIG. 17, the ADF control table information indicates ADF control details for each door status. To be more specific, the ADF control details include: reducing step-size parameter $\mu$ to half of that used in a normal condition (or more specifically, reducing an update amount of the filter coefficient); and doubling the $\alpha$ coefficient used in a normal condition. In FIG. 17, "ADF for speaker SP0 (hereinafter, also referred to as ADF0) refers to adaptive filter applier 13 that outputs the cancel signal to speaker SP0. Here, ADF0 may include both adaptive filter applier 13, which outputs the cancel signal to speaker SP0, and filter coefficient updater 15, which updates the filter coefficient of adaptive filter applier 13.

For example, suppose that the door status information indicates that only door DR0 among the five doors is opened. In this case, controller 17 determines control details so that: ADF0 and ADF1 among ADF0 to ADF4 are deactivated; step-size parameter $\mu$ is reduced to half of that used in the normal condition to activate ADF2 and ADF3; and ADF4 is activated normally.

Moreover, suppose that the door status information indicates that only doors DR1 and DR2 among the five doors are opened. In this case, controller 17 determines control details so that: ADF0 to ADF3 are deactivated; and step-size parameter μ is reduced to half of that used in the normal condition to activate ADF4. Then, controller 17 limits the outputs of the cancelling sounds on the basis of the control details determined in Step S62 (S63). In other words, controller 17 performs the control as determined.

As described above, controller 17 determines which one of ADF0 to ADF4 corresponding to speakers SP0 to SP4 is activated to perform the operation different from the normal-condition operation, by reference to the door status information (or more specifically, the door status signal including the door identification information) and the table information. The operation different from the normal-condition operation includes, for example: activation of the ADF using a corrected step-size parameter for determining the update amount of the filter coefficient; and activation of the ADF using the corrected α coefficient. Such determination of the control details for the ADFs by reference to the control table information enables the ADF control while simplifying an algorithm for determining the control details.

Embodiment 2

[Configuration]

Figure 18:
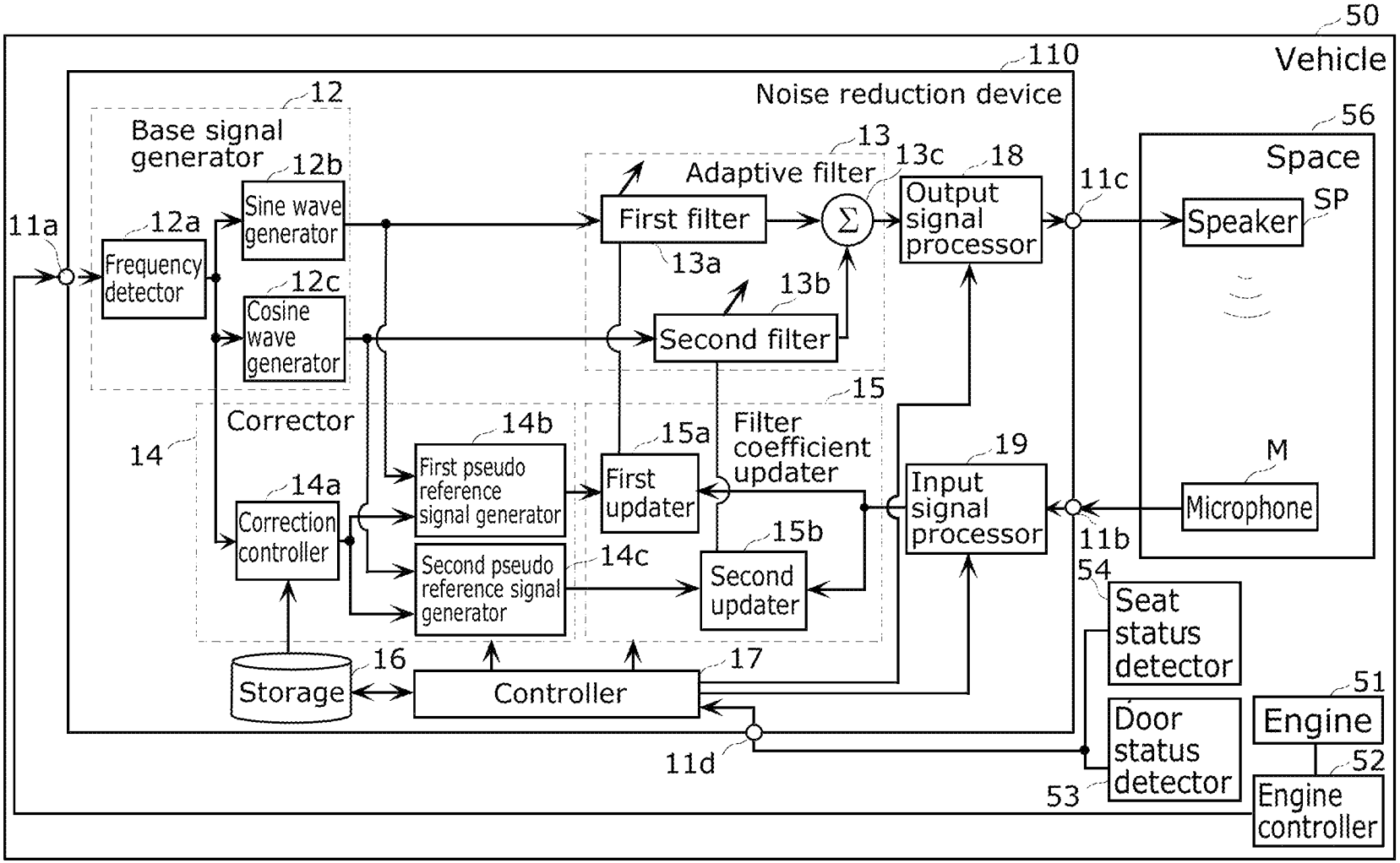
FIG. 18 is a functional block diagram of a noise reduction device according to Embodiment 2.

The following describes a configuration of a noise reduction device according to Embodiment 2. FIG. 18 is a functional block diagram of a noise reduction device according to Embodiment 2. Note that matters already discussed in Embodiment 1 are simplified or omitted from Embodiment 2.

As illustrated in FIG. 18, noise reduction device 110 is different from noise reduction device 10 in that output signal processor 18 is interposed between an output of adaptive filter applier 13 and cancel signal output terminal 11*c*.

Output signal processor 18 is a limiter circuit that limits a maximum amplitude of a cancel signal outputted from adaptive filter applier 13 (that is, a maximum output level) to a threshold value or lower. Controller 17 controls whether to activate output signal processor 18 to limit the amplitude of the cancel signal (that is, to turn on output signal processor 18) or to output the cancel signal to cancel signal output terminal 11*c* without activating output signal processor 18 (that is, to turn off output signal processor 18). For example, output signal processor 18 limits the amplitude through a fade-out process for the cancel signal having an amplitude higher than the threshold value. This reduces an abnormal noise that may be caused by abrupt limitation in the signal amplitude. Here, controller 17 can also change this threshold value.

Moreover, noise reduction device 110 is different from noise reduction device 10 in that input signal processor 19 is interposed between error signal input terminal 11*b* and an input of filter coefficient updater 15.

Input signal processor 19 is a gain control circuit that attenuates an error signal using a gain coefficient lower than a normal-condition gain coefficient after the fade-out process performed on the error signal (the process allowing a predetermined period of time to attenuate the error signal). Controller 17 controls whether to activate input signal processor 19 to perform the fade-out process on the error signal. Here, input signal processor 19 can also mute the error signal.

Furthermore, input signal processor 19 can also return the lower gain coefficient to the normal-condition gain coefficient after a fade-in process performed on the error signal (the process allowing a predetermined period of time to amplify the error signal). Controller 17 controls whether to activate input signal processor 19 to perform the fade-in process on the error signal.

[Fifth Example of Process for Limiting Canceling Sound]

Figure 19:
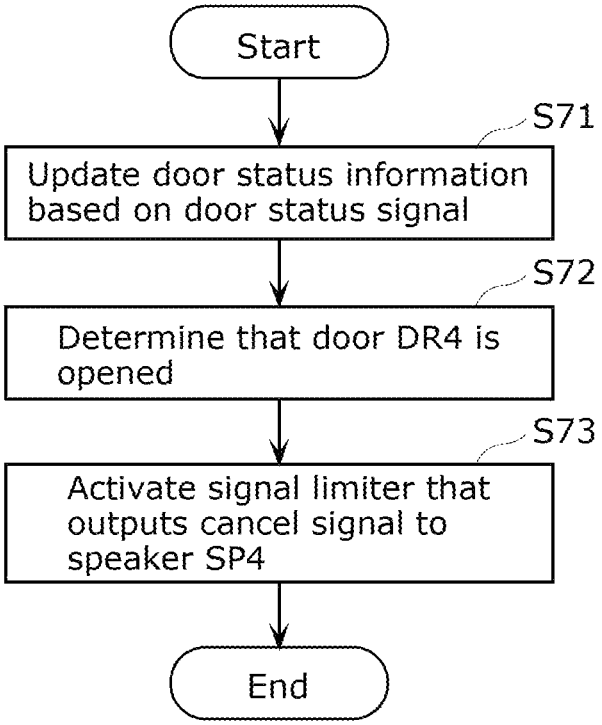
FIG. 19 is a flowchart according to a fifth example of the process for limiting the cancelling sound.

Noise reduction device 110 can perform the process for limiting the cancelling sound in Step S25, using output signal processor 18. FIG. 19 is a flowchart according to the fifth example of the process for limiting the cancelling sound.

When obtaining a door status signal, controller 17 updates the door status information stored in storage 16 on the basis of the obtained door status signal (S71). If determining that door DR4 is opened by reference to the updated door status information (S72), controller 17 activates output signal processor 18 that outputs the cancel signal to speaker SP4 (S73). Here, output signal processor 18 is not activated in a normal condition. Note that output signal processor 18 may be activated all the time. In this case, if determining that door DR4 is opened, controller 17 may lower a threshold value of output signal processor 18 that outputs the cancel signal to speaker SP4.

As described above, controller 17 of noise reduction device 110 limits the output level of the cancelling sound from speaker SP4 in Step S25. Such limitation on the cancelling sound using output signal processor 18 reduces an abnormal noise that may be caused by the cancelling sound, without completely stopping the output of the cancelling sound.

Controller 17 may change the threshold value of output signal processor 18 according to the frequency of noise. In this case, noise reduction device 110 can perform an operation similar to a normal-condition operation without lowering the threshold value of output signal processor 18, in a frequency range where change in the transmission characteristic is small.

FIG. 19 illustrates an example in which output signal processor 18, which outputs the cancel signal to speaker SP4, is activated when door DR4 is determined as being opened. However, FIG. 19 illustrates merely an example. As in Embodiment 1, output signal processor 18 may be controlled by reference to table information that indicates, for each door status, control details for output signal processors 18 corresponding to speakers SP0 to SP4, for example.

[Sixth Example of Process for Limiting Canceling Sound]

Figure 20:
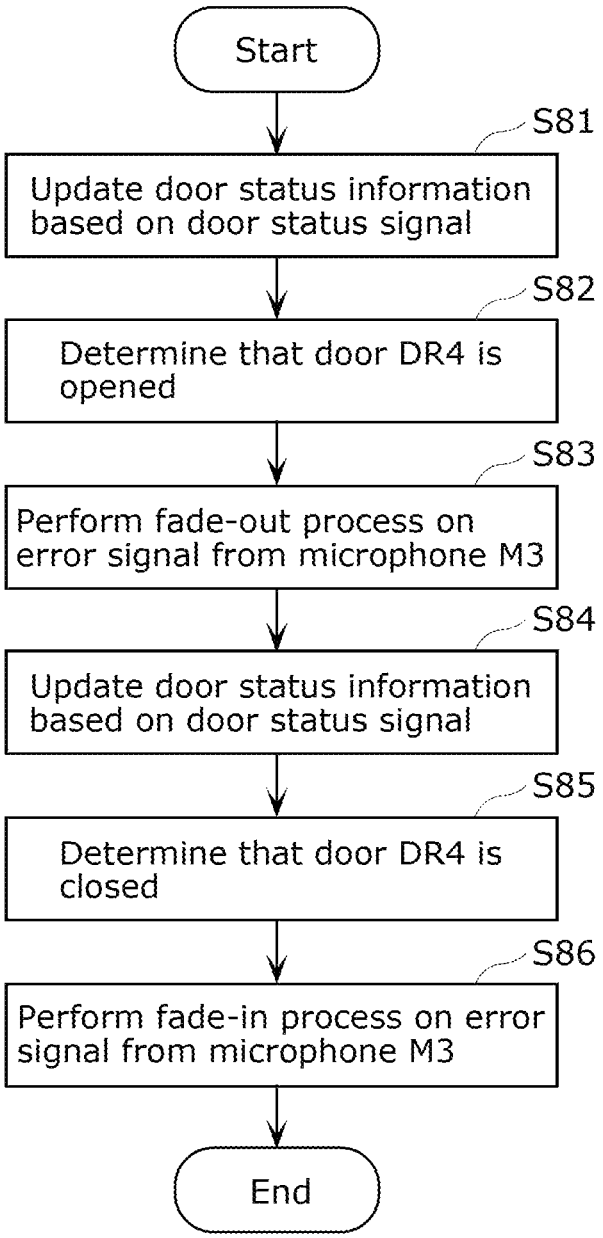
FIG. 20 is a flowchart according to a sixth example of the process for limiting the cancelling sound.

Noise reduction device 110 can perform the process for limiting the cancelling sound in Step S25, using input signal processor 19. FIG. 20 is a flowchart according to the sixth example of the process for limiting the cancelling sound.

When obtaining a door status signal, controller 17 updates the door status information stored in storage 16 on the basis of the obtained door status signal (S81). If determining that door DR4 is opened by reference to the updated door status information (S82), controller 17 causes input signal processor 19, which obtains an error signal from microphone M3, to perform the fade-out process on this error signal (S83). A first predetermined period is allowed to gradually decrease the gain of the error signal through the fade-out process. The gain is attenuated to a predetermined value, and is constant after the end of the first predetermined period. This gain is maintained until door DR4 is closed.

Following this, when obtaining a door status signal, controller 17 updates the door status information stored in storage 16 on the basis of the obtained door status signal (S84). If determining that door DR4 is closed by reference to the updated door status information (S85), controller 17 causes input signal processor 19, which obtains an error signal from microphone M3, to perform the fade-in process on this error signal (S86). A second predetermined period is allowed to gradually increase the gain of the error signal through the fade-in process. The gain reaches the same value as in the normal condition (that is, the same value as before the fade-out process in Step S83) and is constant after the end of the second predetermined period. The first predetermined period and the second predetermined period may or may not be of the same length.

As described above, controller 17 of noise reduction device 110 performs the fade process on the error signal from microphone M3 in Step S25. For example, the error signal is attenuated through the fade-out process. The attenuation of the error signal by input signal processor 19 prevents generation of a cancel signal that may decrease stability. Moreover, the fade process performed on the error signal reduces an abnormal noise that may be caused by abrupt change in the error signal.

FIG. 20 illustrates an example in which input signal processor 19, which obtains the error signal from microphone M3, is activated when door DR4 is determined as being opened. However, FIG. 20 illustrates merely an example. As in Embodiment 1, input signal processor 19 may be controlled by reference to table information that indicates, for each door status, control details for input signal processors 19 corresponding to microphones M0 to M3, for example.

In Embodiment 2 as described above, output signal processor 18 and input signal processor 19 are added. Thus, a control range is increased as compared to the first to fourth examples in which the input signal and the output signal are stopped. This enables control that maintains noise-cancelling performance to the extent possible.

CONCLUSION

As described thus far, noise reduction device 10 reduces noise occurring in space 56 inside a mobile apparatus. Noise reduction device 10 includes: reference signal input terminal 11*a* to which a reference signal correlating with the noise is inputted; adaptive filter applier 13 that generates a cancel signal used in an output of a cancelling sound for reducing the noise, by applying an adaptive filter, which has a coefficient sequentially updated, to a base signal having a frequency identified on the basis of the reference signal inputted; cancel signal output terminal 11*c* that outputs the cancel signal generated to speaker SP placed in space 56; status signal input terminal 11*d* to which a status signal indicating a status of a movable component provided for the mobile apparatus is inputted; and controller 17 that, when the status signal inputted indicates that the movable component is not in a predetermined base status, performs control over the output of the cancelling sound differently in each case, depending on whether or not the status signal includes information indicating a shift amount of the movable component. Reference signal input terminal 11*a* is an example of a reference signal receiver. Cancel signal output terminal 11*c* is an example of a cancel signal output unit. Status signal input terminal 11*d* is an example of a status signal receiver.

Noise reduction device 10 described above performs control appropriately according to the presence or absence the information indicating the shift amount of the movable component. This can prevent unstable noise control in space 56.

For example, when determining that the status signal inputted includes the information indicating the shift amount of the movable component, controller 17 performs the control by correcting, on the basis of the shift amount, a simulated transmission characteristic that is to be used for updating the coefficient.

When the information indicating the shift amount of the movable component is obtained, noise reduction device 10 described above corrects simulated transmission characteristic $C_1$ on the basis of this information. This can prevent unstable noise control in space 56.

For example, the coefficient of the adaptive filter is updated using the base signal and a signal obtained by multiplying an output of adaptive filter applier 13 by a different coefficient ($\alpha$ coefficient).

Noise reduction device 10 described above can stabilize the noise control.

For example, when determining that the status signal inputted includes the information indicating the shift amount of the movable component, controller 17 corrects the different coefficient (the $\alpha$ coefficient) and a step-size parameter.

Noise reduction device 10 described above corrects the $\alpha$ coefficient or the step-size parameter. This can prevent unstable noise control in space 56.

For example, when determining that the status signal inputted does not include the information indicating the shift amount of the movable component, controller 17 performs the control by stopping the output of the cancelling sound from speaker SP.

Noise reduction device 10 described above stops the cancelling sound when the information indicating the shift amount of the movable component is not obtained. This can prevent unstable noise control in space 56.

For example, when determining that the status signal inputted does not include the information indicating the shift amount of the movable component, controller 17 performs the control by muting an error signal that is outputted from a microphone placed in space 56 and that is used for updating the coefficient.

Noise reduction device 10 described above mutes the error signal when the information indicating the shift amount of the movable component is not obtained. This can prevent unstable noise control in space 56.

For example, when determining that the status signal inputted does not include the information indicating the shift amount of the movable component, controller 17 performs the control by more limiting a frequency range of the noise that is to be reduced by the cancelling sound, as compared to a case where the movable component is in the predetermined base status.

Noise reduction device 10 described above limits the frequency range of noise that is to be reduced by the cancelling sound, when the information indicating the shift amount of the movable component is not obtained. This can prevent unstable noise control in space 56.

For example, when determining that the status signal inputted does not include the information indicating the shift amount of the movable component, controller 17 performs the control by correcting a step-size parameter used for determining an update amount of the coefficient.

Noise reduction device 10 described above corrects the step-size parameter when the information indicating the shift amount of the movable component is not obtained. This can prevent unstable noise control in space 56.

For example, the coefficient of the adaptive filter is updated using the base signal and a signal obtained by multiplying an output of adaptive filter applier 13 by a different coefficient ($\alpha$ coefficient). When determining that the status signal inputted does not include the information indicating the shift amount of the movable component, controller 17 performs the control by correcting the different coefficient (the α coefficient).

Noise reduction device 10 described above corrects the α coefficient when the information indicating the shift amount of the movable component is not obtained. This can prevent unstable noise control in space 56.

In Embodiment 2, when determining that the status signal inputted does not include the information indicating the shift amount of the movable component, controller 17 performs the control by limiting an output level of the cancelling sound from speaker SP. For example, output signal processor 18 is used to limit the output level.

Noise reduction device 110 described above limits the output level of the cancelling sound when the information indicating the shift amount of the movable component is not obtained. This can prevent unstable noise control in space 56.

In Embodiment 2, when determining that the status signal inputted does not include the information indicating the shift amount of the movable component, controller 17 performs the control by performing a fade process on an error signal that is outputted from a microphone placed in space 56 and that is used for updating the coefficient. For example, input signal processor 19 is used in the fade process.

Noise reduction device 110 described above performs the fade process on the error signal when the information indicating the shift amount of the movable component is not obtained. This can prevent unstable noise control in space 56.

For example, when determining that the status signal inputted does not include the information indicating the shift amount of the movable component, controller 17 performs the control on the basis of identification information of the movable component that is included in the status signal inputted.

Noise reduction device 10 described above performs control appropriately depending on which one of the movable components changes in status. This can prevent unstable noise control in space 56.

For example, space 56 includes: a plurality of speakers SP0 to SP4 each of which outputs the cancelling sound; and a plurality of microphones M0 to M3 each of which outputs an error signal used for updating the coefficient. Controller 17 performs the control by determining which one of the plurality of speakers SP0 to SP4 is to be stopped from outputting the cancelling sound and determining which one of the plurality of microphones M0 to M3 is to have the error signal to be muted, on the basis of the identification information. For example, controller 17 stops the output of the cancelling sound from a speaker, among speakers SP0 to SP4, located closest to the movable component indicated by the identification information. Moreover, controller 17 mutes the error signal from a microphone, among microphones M0 to M3, located closest to the movable component indicated by the identification information.

Noise reduction device 10 described above stops the cancelling sound from at least one of speakers SP0 to SP4, depending on which one of the movable components changes in status. This can prevent unstable noise control in space 56. Moreover, noise reduction device 10 mutes the error signal from at least one of microphones M0 to M3, depending on which one of the movable components changes in status. This can prevent unstable noise control in space 56.

For example, space 56 includes: a plurality of speakers SP0 to SP4 each of which outputs the cancelling sound; and a plurality of microphones M0 to M3 each of which outputs an error signal used for updating the coefficient. Controller 17 performs the control by deactivating at least one of the plurality of speakers SP0 to SP4 and at least one of the plurality of microphones M0 to M3 on the basis of the identification information, when the noise has a predetermined frequency.

Noise reduction device 10 described above deactivates at least one of the speakers and at least one of the microphones when the noise has the predetermined frequency, depending on which one of the movable components changes in status. This can prevent unstable noise control in space 56.

For example, space 56 includes a plurality of speakers SP0 to SP4 each of which outputs the cancelling sound. Controller 17 performs the control by determining, on the basis of the identification information, which one of a plurality of adaptive filter appliers 13 (ADF0 to ADF4) corresponding to the plurality of speakers SP0 to SP4 is to perform an operation different from a normal-condition operation.

Noise reduction device 10 described above deactivates at least one of speakers SP0 to SP4 and at least one of microphones M0 to M3 when the noise has the predetermined frequency, depending on which one of the movable components changes in status. This can prevent unstable noise control in space 56.

For example, the mobile apparatus is vehicle 50. The status signal indicates one of: a status of a door provided for vehicle 50; and a status of seat ST provided for vehicle 50. The information indicating the shift amount of the movable component is not included in the status signal indicating the status of the door provided for vehicle 50 and included in the status signal indicating the status of seat ST provided for vehicle 50.

The mobile apparatus described above performs control appropriately according to whether the movable component is a door or a seat. This can prevent unstable noise control in space 56.

More specifically, noise reduction device 10 further includes: corrector 14 that generates a corrected base signal by applying, to the base signal, a simulated transmission characteristic obtained by simulating a characteristic of transmission between a position of speaker SP and a position of microphone M; and filter coefficient updater 15 that sequentially updates the coefficient using an error signal outputted from microphone M and the corrected base signal generated.

The mobile apparatus includes noise reduction device 10 and speaker SP.

The mobile apparatus described above performs control appropriately according to the presence or absence the information indicating the shift amount of the movable component. This can prevent unstable noise control in space 56.

A noise reduction method executed by a computer, such as noise reduction device 10, reduces noise occurring in a space inside a mobile apparatus. The noise reduction method includes: generating a cancel signal used in an output of a cancelling sound for reducing the noise, by applying an adaptive filter, which has a coefficient sequentially updated, to a base signal having a frequency identified on the basis of a reference signal correlating with the noise; outputting the cancel signal generated to a speaker placed in space 56; and performing, when a status signal indicating a status of a movable component provided for the mobile apparatus indicates that the movable component is not in a predetermined base status, control over the output of the cancelling sound differently in each case, depending on whether or not the status signal includes information indicating a shift amount of the movable component.

The noise reduction method described above achieves control appropriately according to the presence or absence the information indicating the shift amount of the movable component. This can prevent unstable noise control in space 56.

Other Embodiments

Although the embodiments have been described thus far, the present disclosure is not limited to these embodiments.

For example, the process for correcting the simulated transmission characteristic described in the above embodiment may be performed in parallel with the process for limiting the cancelling sound described in the above embodiment. To be more specific, while the phase correction for the transmission characteristic is performed using the seat position information, the control may be partially stopped due to an open door in this state.

In the above embodiments, examples of the movable component are the seats and doors. However, the examples also include a folding roof provided for the vehicle. A movable component may be any structure that is provided for the mobile apparatus and affects, when shifted, the transmission characteristic of the space inside the mobile apparatus.

In the above embodiments, the door status signal does not include information indicating the shift amount of the door. However, the door status signal may include the information indicating the shift amount of the door. Similarly, although the seat status signal includes the information indicating the shift amount of the seat in the above embodiments, the seat status signal may not include the information indicating the shift amount of the seat.

In the above embodiments, the speakers are attached to the doors and the microphones are attached to the seats. However, the arrangement of the speakers and the arrangement of the microphones are not particularly intended to be limiting. For example, the microphones may be attached to the doors and the speakers may be attached to the seats. Moreover, the speakers and the microphones are not necessarily required to be attached to the movable components. The speakers and microphones may be provided near the movable components or attached to components other than the movable components (for example, an immovable component like a dashboard).

The noise reduction device according to the above embodiments may be installed in a mobile apparatus other than a vehicle. The mobile apparatus may be an aircraft or a ship, for example. Moreover, the present disclosure may be implemented as such mobile apparatus other than a vehicle.

Although the engine is described as the noise source according to the above embodiments, this is not particularly intended to be limiting. The noise source may be a motor, for example.

The configurations according to the above embodiments are merely examples. For example, the noise reduction device may include a component, such as a D/A converter, a low-pass filter (LPF), a high-pass filter (HPF), a power amplifier, or an A/D converter.

The processes performed by the noise reduction device according to the above embodiments are merely examples. For example, some of the processes described in the above embodiments may be achieved by an analog signal process instead of a digital signal process.

For example, it is possible in the above-described embodiments that the process performed by a certain processing unit may be performed by another processing unit, that an order of a plurality of processes is changed, or that a plurality of processes are performed in parallel.

Each of the elements in each of the above embodiments may be configured in the form of an exclusive hardware product, or may be realized by executing a software program suitable for the element. Each of the elements may be realized by means of a program executing unit, such as a CPU or a processor, reading and executing the software program recorded on a recording medium such as a hard disk or semiconductor memory.

The elements may be implemented to circuits (or integrated circuits). These circuits may form a single circuit, or serve as separate circuits. Each circuit may be a general-purpose circuit or a dedicated circuit.

General or specific aspects of the present disclosure may be implemented to a system, a device, a method, an integrated circuit, a computer program, a non-transitory computer-readable recording medium such as a Compact Disc-Read Only Memory (CD-ROM), or any given combination thereof.

For example, the present disclosure may be implemented as a noise reduction method executed by a computer, such as a noise reduction device (DSP). Alternatively, the present disclosure may be implemented as a program causing the computer (DSP) to execute the noise reduction method. Moreover, the present disclosure may be implemented as a noise reduction system that includes the noise reduction device described in the above embodiments, a speaker (a sound output unit), and a microphone (a sound collector).

The order of processes performed by the noise reduction device described in the above embodiments is an example. The order of the processes may be changed, or the processes may be performed in parallel.

In addition, the present disclosure may include embodiments obtained by making various modifications on the above embodiments which those skilled in the art will arrive at, or embodiments obtained by selectively combining the elements and functions disclosed in the above embodiments, without materially departing from the scope of the present disclosure.

INDUSTRIAL APPLICABILITY

The noise reduction device according to the present disclosure is useful for reducing noise in an interior of a vehicle, for example.

While various embodiments have been described herein above, it is to be appreciated that various changes in form and detail may be made without departing from the spirit and scope of the present disclosure as presently or hereafter claimed.

FURTHER INFORMATION ABOUT TECHNICAL BACKGROUND TO THIS APPLICATION

The disclosures of the Japanese Patent Application including specification, drawings and claims are incorporated herein by references on their entirety: Japanese Patent Application No. 2019-207026 filed Nov. 15, 2019.

The invention claimed is:

1. A noise reduction device that reduces noise occurring in a space inside a mobile apparatus, the noise reduction device comprising:

a reference signal receiver to which a reference signal correlating with the noise is inputted;

an adaptive filter applier that generates a cancel signal used in an output of a cancelling sound for reducing the noise, by applying an adaptive filter, which has a coefficient sequentially updated, to a base signal having a frequency identified based on the reference signal inputted;

an output terminal that outputs the cancel signal generated to a speaker in the space;

a status signal receiver to which a status signal indicating a status of a movable component provided for the mobile apparatus is inputted;

a controller that, when the status signal inputted indicates that the movable component is not in a predetermined base status, performs control over the output of the cancelling sound differently, depending on whether or not the status signal includes information indicating a shift amount of the movable component;

a corrector that generates a pseudo reference signal obtained by correcting the reference signal;

a storage; and a filter coefficient updater that includes a first updater, a second updater, a third updater, and a fourth updater, and sequentially updates the coefficient, wherein when determining that the status signal inputted includes the information indicating the shift amount of the movable component, the controller performs the control by correcting, based on the shift amount, a simulated transmission characteristic that is to be used for updating the coefficient, the coefficient of the adaptive filter is updated using the base signal and a signal obtained by multiplying an output of the adaptive filter applier by a different coefficient, in the correcting of the simulated transmission characteristic, the controller reads out a constant corresponding to the shift amount from the storage, calculates a phase correction amount by multiplying the constant read out by the frequency, and calculates a corrected transmission characteristic by adding the phase correction amount to a phase of the simulated transmission characteristic, the corrector generates the pseudo reference signal using the corrected transmission characteristic, the adaptive filter includes a first filter and a second filter, the first updater and the third updater update the first filter, the second updater and the fourth updater update the second filter, the third updater updates the first filter, based on an output from a sine wave generator and a signal obtained by multiplying an output from the adaptive filter applier by the different coefficient, and the fourth updater updates the second filter, based on an output from a cosine wave generator and a signal obtained by multiplying an output from the adaptive filter applier by the different coefficient.

2. The noise reduction device according to claim 1, wherein when determining that the status signal inputted includes the information indicating the shift amount of the movable component, the controller corrects the different coefficient and a step-size parameter.

3. The noise reduction device according to claim 1, wherein when determining that the status signal inputted does not include the information indicating the shift amount of the movable component, the controller performs the control by stopping the output of the cancelling sound from the speaker.

4. The noise reduction device according to claim 1, wherein when determining that the status signal inputted does not include the information indicating the shift amount of the movable component, the controller performs the control by muting an error signal that is outputted from a microphone in the space and that is used for updating the coefficient.

5. The noise reduction device according to claim 1, wherein when determining that the status signal inputted does not include the information indicating the shift amount of the movable component, the controller performs the control by more limiting a frequency range of the noise that is to be reduced by the cancelling sound, as compared to a case where the movable component is in the predetermined base status.

6. The noise reduction device according to claim 1, wherein when determining that the status signal inputted does not include the information indicating the shift amount of the movable component, the controller performs the control by correcting a step-size parameter used for determining an update amount of the coefficient.

7. The noise reduction device according to claim 1, when determining that the status signal inputted does not include the information indicating the shift amount of the movable component, the controller performs the control by correcting the different coefficient.

8. The noise reduction device according to claim 1, wherein when determining that the status signal inputted does not include the information indicating the shift amount of the movable component, the controller performs the control by limiting an output level of the cancelling sound from the speaker.

9. The noise reduction device according to claim 1, wherein when determining that the status signal inputted does not include the information indicating the shift amount of the movable component, the controller performs the control by performing a fade process on an error signal that is outputted from a microphone in the space and that is used for updating the coefficient.

10. The noise reduction device according to claim 1, wherein when determining that the status signal inputted does not include the information indicating the shift amount of the movable component, the controller performs the control based on identification information of the movable component that is included in the status signal inputted.

11. The noise reduction device according to claim 10, wherein the space includes: a plurality of speakers each of which outputs the cancelling sound; and a plurality of microphones each of which outputs an error signal used for updating the coefficient, and the controller performs the control by determining which one of the plurality of speakers is to be stopped from outputting the cancelling sound and determining which one of the plurality of microphones is to have the error signal to be muted, based on the identification information.

12. The noise reduction device according to claim 10, wherein the space includes: a plurality of speakers each of which outputs the cancelling sound; and a plurality of microphones each of which outputs an error signal used for updating the coefficient, and the controller performs the control by deactivating at least one of the plurality of speakers and at least one of the plurality of microphones based on the identification information, when the noise has a predetermined frequency.

13. The noise reduction device according to claim 10, wherein the space includes a plurality of speakers each of which outputs the cancelling sound, the adaptive filter applier comprises a plurality of adaptive filter appliers corresponding to the plurality of speakers, and the controller performs the control by determining, based on the identification information, which one of the plurality of adaptive filter appliers is to perform an operation different from a normal-condition operation.

14. The noise reduction device according to claim 1, wherein the mobile apparatus is a vehicle, the status signal indicates one of: a status of a door provided for the vehicle; and a status of a seat provided for the vehicle, and the information indicating the shift amount of the movable component is not included in the status signal indicating the status of the door provided for the vehicle and included in the status signal indicating the status of the seat provided for the vehicle.

15. The noise reduction device according to claim 1, further comprising:

a corrector that generates a corrected base signal by applying, to the base signal, the simulated transmission characteristic obtained by simulating a characteristic of transmission between a position of the speaker and a position of a microphone, wherein the filter coefficient updater sequentially updates the coefficient using an error signal outputted from the microphone and the corrected base signal generated.

16. A mobile apparatus, comprising:

the noise reduction device according to claim 1; and the speaker.

17. A noise reduction method for reducing noise occurring in a space inside a mobile apparatus, the noise reduction method comprising:

generating a cancel signal used in an output of a cancelling sound for reducing the noise, by applying an adaptive filter, which has a coefficient sequentially updated, to a base signal having a frequency identified based on a reference signal correlating with the noise;

outputting the cancel signal generated to a speaker in the space;

performing, when a status signal indicating a status of a movable component provided for the mobile apparatus indicates that the movable component is not in a predetermined base status, control over the output of the cancelling sound differently, depending on whether or not the status signal includes information indicating a shift amount of the movable component;

generating a pseudo reference signal obtained by correcting the reference signal; and sequentially updating the coefficient, wherein, when determining that the status signal inputted includes the information indicating the shift amount of the movable component, the performing performs control by correcting, based on the shift amount, a simulated transmission characteristic that is to be used for updating the coefficient, the coefficient of the adaptive filter is updated using the base signal and a signal obtained by multiplying an output of the adaptive filter applier by a different coefficient, in the correcting of the simulated transmission characteristic, the noise reduction method reads out a constant corresponding to the shift amount from a storage, calculates a phase correction amount by multiplying the constant read out by the frequency, and calculates a corrected transmission characteristic by adding the phase correction amount to a phase of the simulated transmission characteristic, the pseudo reference signal is generated using the corrected transmission characteristic, the adaptive filter includes a first filter and a second filter, a first updater and a third updater update the first filter, a second updater and a fourth updater update the second filter, the third updater updates the first filter, based on an output from a sine wave generator and a signal obtained by multiplying an output from the adaptive filter applier by the different coefficient, and the fourth updater updates the second filer, based on an output from a cosine wave generator and a signal obtained by multiplying an output from the adaptive filter applier by the different coefficient.

18. A noise reduction device that reduces noise occurring in a space inside a mobile apparatus, the noise reduction device comprising:

a processor; and a memory including a program that, when executed by the processor, causes the processor to perform operations, the operations including:

receiving a reference signal correlating with the noise;

generating a cancel signal used in an output of a cancelling sound for reducing the noise, by applying an adaptive filter, which has a coefficient sequentially updated, to a base signal having a frequency identified based on the reference signal;

outputting the cancel signal to a speaker in the space;

receiving a status signal indicating a status of a movable component provided for the mobile apparatus;

when the status signal indicates that the movable component is not in a predetermined base status, performing control over the output of the cancelling sound differently, depending on whether or not the status signal includes information indicating a shift amount of the movable component;

generating a pseudo reference signal obtained by correcting the reference signal; and sequentially updating a filter coefficient, wherein, when determining that the status signal includes the information indicating the shift amount of the movable component, the processor performs the control by correcting, based on the shift amount, a simulated transmission characteristic that is to be used for updating the coefficient, the coefficient of the adaptive filter is updated using the base signal and a signal obtained by multiplying an output of the adaptive filter applier by a different coefficient, in the correcting of the simulated transmission characteristic, the processor reads out a constant corresponding to the shift amount from the memory, calculates a phase correction amount by multiplying the constant read out by the frequency, and calculates a corrected transmission characteristic by adding the phase correction amount to a phase of the simulated transmission characteristic, the pseudo reference signal is generated using the corrected transmission characteristic, the adaptive filter includes a first filter and a second filter, a first updater and a third updater update the first filter, a second updater and a fourth updater update the second filter, the third updater updates the first filter, based on an output from a sine wave generator and a signal obtained by multiplying an output from the adaptive filter applier by the different coefficient, and the fourth updater updates the second filter, based on an output from a cosine wave generator and a signal obtained by multiplying an output from the adaptive filter applier by the different coefficient.

* * * * *